US006876877B2

(12) United States Patent
Eden

(10) Patent No.: US 6,876,877 B2
(45) **Date of Patent: *Apr. 5, 2005**

(54) HIGH TEMPERATURE SUPERCONDUCTOR TUNABLE FILTER HAVING A MOVABLE SUBSTRATE CONTROLLED BY A MAGNETIC ACTUATOR

(75) Inventor: Richard C. Eden, Briarcliff, TX (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/355,461

(22) Filed: Jan. 31, 2003

(65) Prior Publication Data

US 2003/0227348 A1 Dec. 11, 2003

Related U.S. Application Data

(63) Continuation of application No. 09/517,222, filed on Mar. 2, 2000, now Pat. No. 6,516,208.

(51) Int. Cl.[7] ..... H01P 1/203; H01B 12/02

(52) U.S. Cl. ..... 505/210; 333/99 S; 333/205; 505/211; 505/700; 505/705

(58) Field of Search ..... 333/99 S, 205; 505/210, 211, 700, 705

(56) References Cited

U.S. PATENT DOCUMENTS

| | | | | |
|---|---|---|---|---|
| 4,912,086 A | * | 3/1990 | Enz et al. | 505/706 X |
| 5,099,162 A | | 3/1992 | Sawada | |
| 5,126,317 A | | 6/1992 | Agarwala | |
| 5,391,543 A | | 2/1995 | Higaki et al. | |
| 5,604,375 A | | 2/1997 | Findikoglu et al. | |
| 5,808,527 A | | 9/1998 | De Los Santos | |
| 5,968,876 A | | 10/1999 | Sochor | |
| 6,016,434 A | | 1/2000 | Mizuno et al. | |
| 6,049,726 A | | 4/2000 | Gruenwald et al. | |
| 6,347,237 B1 | | 2/2002 | Eden et al. | |
| 6,437,965 B1 | | 8/2002 | Adkins et al. | |
| 6,441,449 B1 | | 8/2002 | Xu et al. | |
| 6,662,029 B2 | | 12/2003 | Eden et al. | |

FOREIGN PATENT DOCUMENTS

| | | |
|---|---|---|
| GB | 2220526 A | 1/1990 |
| JP | 63-028103 A | 2/1988 |

OTHER PUBLICATIONS

Aminov, et al, "YBaCuO Disk Resonator Filters Operating at High Power", IEEE Transactions on Applied Superconductivity, 9, 2, Jun. 1999.

Hammond et al, "Epitaxial $T1_2$ $CaBa_2$ $Cu_2$ $O_8$ Thin Films with Low 9.6 GHz Surface Resistance at High Power and Above 77K", Appl. Phys. Lett. 57, 8, Aug. 20, 1990, 825–827.

Low, "Modeling of Three–Layer Piezoelectric Biomorph Beam With Hysteresis", Journal of Microelectromechanical Systems, 4, 4, Dec. 1995, 230–237.

(Continued)

*Primary Examiner*—Benny T. Lee
(74) *Attorney, Agent, or Firm*—O'Melveny & Myers LLP

(57) ABSTRACT

A circuit is provided wherein the electronic properties of the circuit are varied by a magnetic actuator. The circuit includes a fixed substrate and a movable substrate. The magnetic actuator comprises a magnetic driver on an upper surface of the fixed substrate that is substantially overlapped by an HTS reaction plate on the lower surface of the fixed substrate. A tuning current applied through a continuous strip of HTS material in the magnetic driver induces a repulsive magnetic force causing the movable substrate to move with respect to the fixed substrate.

20 Claims, 11 Drawing Sheets

OTHER PUBLICATIONS

Mine, et al, "Characteristics of Mechanically Tunable Superconductive Resonators", Supercond. Sci. Technol. 15, 2002, 635–638.

Moeckley, et al, "Strontium Titanate Thin Films for Tunable $Yba_2Cu_{3\ 7}$ Microwave Filters", IEEE Transactions on Applied Superconductivity, 11, 1, Mar. 2001, 450–453.

Oates, et al, "Magnetically Tunable Superconducting Resonators and Filters", IEEE Transactions on Applied Superconductivity, 9, 2, Jun. 1999, 4170–4175.

Soares, et al, "Optical Switching of HTS Band Reject Resonators", IEEE Transactions on Applied Superconductivity, 5, 2, Jun. 1995, 2276–2278.

Terashima, et al, "ZHGz Tunable Superconducting Band–Pass Filter Using a Piezoelectric Bender", Physica C, 366, 2002, 183–189.

Xu, et al, "Active Tuning of High Frequency Resonators and Filters", IEEE Transactions on Applied Superconductivity, 11, 1, Mar. 2001, 353–356.

* cited by examiner

HTS VARIABLE CAPACITOR WITH MAGNETIC DRIVER USING HTS COIL AND HTS REACTION PLATE

"PUSH" (REPULSION) HTS DRIVER GEOMETRY (SCXD HTS REACTION PLATE WITH NO MAGNETIC FLUX TRAPPED IN IT):

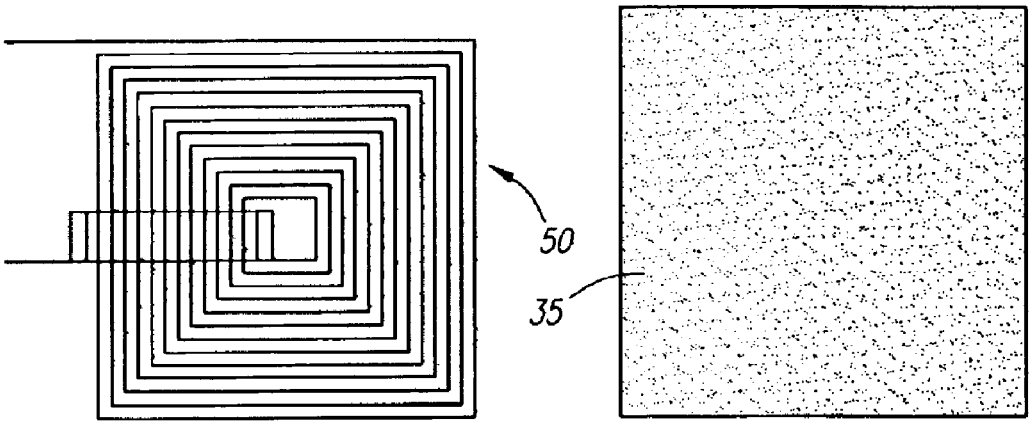

DRIVER COIL ON FIXED SUBSTRATE
APPLIED CURRENT = $I_d$

REACTION PLATE ON MOVABLE SUBSTRATE
EQUIVALENT SUPERCURRENT CURRENT = $I_d$
$F = -I_d^2$

"PUSH-PULL" (REPULSION/ATTRACTION) HTS DRIVER GEOMETRY (PATTERNED HTS REACTION PLATE HAVING MAGNETIC FLUX TRAPPED IN IT):

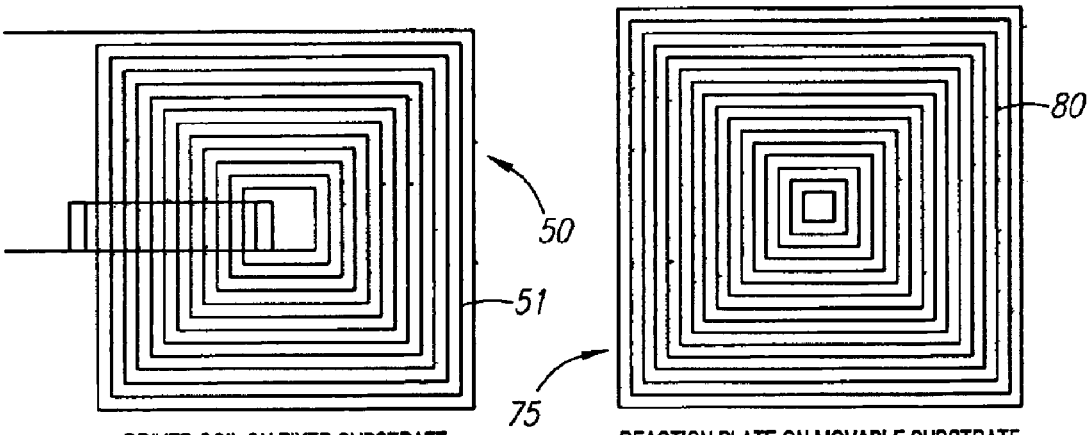

DRIVER COIL ON FIXED SUBSTRATE
"POLING" CURRENT = $I_p$
APPLIED CURRENT = $I_d$

REACTION PLATE ON MOVABLE SUBSTRATE
EQUIVALENT SUPERCURRENT CURRENT = $I_p$-$I_d$
$F = I_d(I_p - I_d)$

*FIG. 6*

FORCE vs. Id FOR "PUSH" HTS DRIVER

FORCE vs. Id FOR "PUSH-PULL" HTS DRIVER

HIGH TEMPERATURE SUPERCONDUCTOR TUNABLE FILTER HAVING A MOVABLE SUBSTRATE CONTROLLED BY A MAGNETIC ACTUATOR

RELATED APPLICATION

This application is a continuation of U.S. Ser. No. 09/517,222, filed Mar. 2, 2000, entitled "High Temperature Superconductor Tunable Filters", issued on Feb. 4, 2003, as U.S. Pat. No. 6,516,208. The above-identified U.S. Application is incorporated by reference as if set forth fully herein. This application relates to U.S. Ser. No. 09/268,786, filed Mar. 16, 1999 issued on Feb. 12, 2002 as U.S. Pat. No. 6,347,237.

FIELD OF THE INVENTION

This invention relates to a high temperature superconductor (HTS) tunable filter. More particularly, this invention relates to an HTS filter tunable by actuating a magnetic driver.

BACKGROUND OF THE INVENTION

The need for a high-quality factor (Q), low insertion loss tunable filter pervades a wide range of microwave and RF applications, in both the military, e.g., RADAR, communications and Electronic Intelligence (ELINT), and the commercial fields such as in various communications applications, including cellular. Placing a sharply defined bandpass filter directly at the receiver antenna input will often eliminate various adverse effects resulting from strong interfeing signals at frequencies near the desired signal frequency in such applications. Because of the location of the filter at the receiver antenna input, the insertion loss must be very low to not degrade the noise figure. In most filter technologies, achieving a low insertion loss requires a corresponding compromise in filter steepness or selectivity. In the present invention, the extremely low loss property of high-temperature superconductor (HTS) filter elements provides an attractive solution, achieving a very low insertion loss yet simultaneously allowing a high selectivity/steepness bandpass definition.

In many applications, particularly where frequency hopping is used, a receiver filter must be tunable to either select a desired frequency or to trap an interfering signal frequency. The vast majority of lumped element tunable filters have used varactor diodes. Such a design amounts to using a tunable capacitor because varactor diodes, by changing the reverse bias voltage, vary the depletion thickness and hence the P-N junction capacitance. While varactors are simple and robust, they have limited Q's, and suffer from the problem that the linear process that tunes them extends all of the way to the signal frequency, so that high-amplitude signals create, through the resulting nonlinearities, undesirable intermodulation products and other problems.

Consider the case of a conventional varactor diode. In a varactor, the motion of electrons accomplishes the tuning itself. As the reverse bias voltage (Vr) on the junction of the varactor is changed, then in accordance with Poisson's Equation, the width of the P-N junction depletion region changes, which alters the junction capacitance ($C_j$). Because the tuning mechanism of varactors is electronic, the tuning speed is extremely fast. Unfortunately, this also leads to a serious associated disadvantage: limited dynamic range. Because the $C_j$ ($V_r$) relationship is nearly instantaneous in response, extending to changes in $V_r$ at the signal frequency itself, and the input signal (frequently in a resonantly magnified form) appears as a component of the junction bias voltage $V_r$, the input signal itself parametrically modulates the junction capacitance. If the signal amplitude across the varactor is very small in comparison to the dc bias, the effect is not too serious. Unfortunately, for high signal amplitudes, this parametric modulation of the capacitance can produce severe cross-modulation (IM) effects between different signals, as well as harmonic generation and other undesirable effects. While these signal-frequency varactor capacitance variations are the basis of useful devices such as parametric amplifiers, subharmonic oscillators, frequency multipliers, and many other useful microwave circuits, in the signal paths of conventional receivers they are an anathema. This inherent intermodulation or dynamic range problem will presumably extend to "tunable materials", such as ferroelectrics or other materials in which the change of dielectric constant ($\epsilon_r$) with applied electric field (E) is exploited to tune a circuit. As long as the $\epsilon_r$ (E) relationship applies out to the signal frequency, then the presence of the signal as a component of E will lead to the same intermodulation problems that the varactors have.

In addition to the intermodulation/dynamic range problems of varactors, these conventional tuning devices also have serious limitations in Q, or tuning selectivity. Because the varactors operate by varying the depletion region width of a P-N junction, at lower reverse bias voltages (higher capacitances), there is a substantial amount of undepleted moderately-doped semiconductor material between the contacts and the P-N junction that offers significant series resistance ($R_{ac}$) to ac current flow. Since the Q of a varactor having junction capacitance $C_j$ and series resistance $R_{ac}$ at an input signal frequency f is given by $Q=1/(2\ f\ C_j\ R_{ac})$, the varactor Q values are limited, particularly at higher frequencies. For example, a typical commercial varactor might have $C_j$=2.35 pF with $R_{ac}$=1.0 Ω at $V_r$=−4V, or $C_j$=1.70 pF with $R_{ac}$=0.82 Ωat $V_r$=−10V, corresponding to Q values at f=1.0 GHz of Q=68 at V, =4V or Q=114 at $V_r$=−10V (or f=10.0 GHz values of Q=6.8 and Q=11.4, respectively). Considering that an interesting X-band (f=10 GHz) RADAR application might want a bandwidth of Δf=20 MHz (FWHM), corresponding to a Q=f/Δf=500 quality factor, we see that available varactors have inadequate Q (too much loss) to meet such requirements. While the mechanisms are different, this will very likely apply to the use of ferroelectrics or other "tunable materials." A general characteristic of materials which exhibit the field-dependent dielectric constant nonlinearities (that makes them tunable) is that they exhibit substantial values of the imaginary part of the dielectric constant (or equivalently, loss tangent). This makes it unlikely that, as in varactors, these "tunable materials" will be capable of achieving high Q's, particularly at high signal frequencies.

An additional problem with both varactors and "tunable materials" for circuits with high values of Q is that these are basically two-terminal devices; that is, the dc tuning voltage must be applied between the same two electrodes to which the signal voltage is applied. The standard technique is to apply the dc tuning bias through a "bias tee"-like circuit designed to represents a high reactive impedance to the signal frequency to prevent loss of signal power out the bias port (as this., loss would effectively reduce the Q). However, while the design of bias circuits that limit the loss of energy to a percent, or a fraction of a percent of the resonator energy is not difficult, even losses of a fraction of a percent are not nearly good enough for very high Q circuits (e.g., Q's in the $10^3$ to $>10^5$ range, as achievable with HTS resonators). It would be much easier to design such very high Q circuits using three-terminal, or preferably 4-terminal (two-port) variable capacitors in which the tuning voltage is applied to a completely different pair of electrodes from those across which the input signal voltage is applied (with an inherent high degree of isolation between the signal and bias ports).

One new form of variable capacitor that avoids the intermodulation/dynamic range problems of varactors or "tunable materials" approaches is the microelectromechanical (HEMS) variable capacitor. A number of MEMS variable capacitor device structures have been proposed, including elaborate lateral-motion interdigitated electrode capacitor structures. In the simple vertical motion, parallel plate form of this device, a thin layer of dielectric separating normal metal plates (or a normal metal plate from very heavily doped silicon) is etched out in processing to leave a very narrow gap between the plates. The thin top plate is suspended on four highly compliant thin beams which terminate on posts (regions under which the spacer dielectric has not been removed). The device is ordinarily operated in an evacuated package to allow substantial voltages to be applied across the narrow gap between plates without air breakdown (and to eliminate air effects on the motion of the plate and noise). When a dc tuning voltage is applied between the plates, the small electrostatic attractive force, due to the high compliance of the support beams, causes substantial deflection of the movable plate toward the fixed plate or substrate, increasing the capacitance.

Because the change of capacitance, at least in the metal-to-metal plate version of the MEMS variable capacitor, is due entirely to mechanical motion of the plate (as opposed to "instantaneous" electronic motion effects as in varactors or "tunable materials"), the frequency response is limited by the plate mass to far below signal frequencies of interest. Consequently, these MEMS devices will be free of measurable intermodulation or harmonic distortion effects, or other dynamic range problems (up to the point where the combination of bias plus signal voltage across the narrow gap between plates begins to lead to nonlinear current leakage or breakdown effects).

In addition to their freedom from intermodulation/dynamic range problems, normal metal plate MEMS variable capacitor structures offer the potential for substantially lower losses and higher Q's. While the simple parallel plate MEMS structure has a Q problem due to the skin effect resistance, $R_{ac}$, of the long narrow metal leads down the compliant beams supporting the movable plate, an alternative structure is possible which avoids this problem. If the top (movable) plate is made electrically "floating" (from a signal standpoint, it would still have a dc bias lead on it), and the fixed bottom plate split into two equal parts, these two split plates can be used as the signal leads to the MEMS variable capacitor. (The capacitance value is halved, of course, but the tuning range is preserved.) In this "floating plate" configuration, passage of ac current through the long narrow beam leads is avoided, allowing fairly high values of Q to be achieved, even with normal metal plates.

While this conventional MEMS variable capacitor structure is capable of improved Q's and avoids the intermodulation problems of varactors and "tunable materials", it has some potential problems of its own. For example, the electrostatic force attracting the two plates is quite weak, except at extremely short range. The electrostatic force $F_e$ between two parallel plates each of area A with a voltage difference V and a gap separation z is given by $$F_e=-(\epsilon_0 A/2)(V/z)^2 \quad \text{(Eq. 1)}$$

where $\epsilon=8.854\times10^{-12}$ Farad/Meter (F/m) is the permittivity of a vacuum. The extremely rapid falloff of force as the separation gap is increased (as $1/z^2$) makes the useful tuning range of electrostatic drivers quite small. In this parallel-plate MEMS capacitor configuration, if a linear spring provides the restoring force between the plates, when the bias voltage is increased such that the gap separation has dropped to ⅓ of the separation at zero bias, the plate motion becomes unstable and the plates snap together. This limits the useful tuning range to less than 3:1 in capacitance, or less than 1.732:1 in frequency. Further, the short-range nature of the electrostatic force makes its use in variable-inductance tuning even more problematic because of the requirement for very narrow gaps (to give reasonable levels of force at reasonable drive voltages), since much larger gaps (e.g., hundreds of microns) are desirable in devices having such variable-inductance tuning.

The short-range nature of the electrostatic force is illustrated by the following example. In a parallel-plate capacitor having a voltage of 100 volts (which is actually an unreasonably high voltage level given the trends toward low voltage electronics) and a gap separation of 1.0$\mu$ meter ($\mu$m), the electrostatic force (divided by the area of the plates) is 4.514 grams/centimeter$^2$, a reasonable force. Increasing the gap to 10 $\mu$m at the same voltage produces the minuscule attractive force of 0.04514 grams/centimeter$^2$. On the other hand, decreasing the gap to 0.1 $\mu$m at the same voltage produces the robust attractive force of 451.43 gramms/centimeter$^2$, corresponding to an electric field strength of $10^7$ V/cm. Although coating the plates with a thin dielectric and allowing progressive contact of thin curved (stress-bent) layers with a fixed electrode as voltage is increased may counteract the short-range effect of this electrostatic force (and with proper drive plate shaping, extend the tuning range in capacitance beyond 3:1), triboelectric (i.e., charging due to friction) and charge transfer effects under the high field condition tend to give significant hysteresis in the capacitance-voltage (C-V) characteristics of these "window shade" MEMS devices.

In addition, there are other potential problems in conventional MEMS devices. For example, in many system applications for tunable filters, requirements for precise phase make it essential that the selected frequency be very stable and reproducible. Consider a resonator or narrowband filter having a center frequency $F_o$ and a −3 dB bandwidth $\Delta F$ given from its (loaded) quality factor $Q_o$ by the equation $$\Delta F=F_o/Q_o \quad \text{(Eq. 2)}$$

Note that as the frequency is changed from $(F_o-\Delta F/2)$ through $F_o$ to $(F_o+\Delta F/2)$, the phase changes quite dramatically from +45° to 0° to −45°. For a signal frequency f near $F_o$, the phase in a single resonator may be approximated by $$\text{Phase}(^\circ)\approx 2Q_o(180^\circ/\pi)[1-(f/F_o)] \quad \text{(Eq. 3)}$$

(for a single resonator, or $N_r$ times this value for a filter having $N_r$ resonators at $F_o$). Hence, if the allowable phase uncertainty at a given frequency f is denoted by $\Delta$Phase (°), then the allowable error in the resonator center frequency, $\Delta F_o$, near resonance will be $$\Delta F_o/f=\Delta\text{Phase}\ (^\circ)/[2\ Q_o(180^\circ/\pi)]=(0.0087266/Q_o)\Delta\text{Phase}(^\circ) \quad \text{(Eq. 4)}$$

For example, for a 1.0° degree phase error with a loaded $Q_o$=500, the resonator frequency repeatability, $\Delta F_o/f$, must be less than or equal to 0.00175% (for a single resonator, or $1/N_r$ times this value for a number $N_r$ of resonators). This means that for such phase sensitive applications, the tunable elements must achieve levels of repeatability, hysteresis and continuity that appear difficult to achieve in ferroelectric piezoelectric actuators, let alone "window shade" electrostatic MEMS devices.

Therefore, there is a need in the art for new driver structures for varying the properties of MEMS-like HTS capacitors or inductors, or more complex distributed resonator structures having transmission line-like qualities. The resulting variable capacitors, inductors, or other tunable elements may be incorporated into tunable filters or other circuits.

SUMMARY OF THE INVENTION

In one innovative aspect, the present invention comprises a circuit wherein the electronic properties of the circuit are varied by altering the current through a magnetic actuator. The circuit includes a fixed substrate and a movable substrate wherein the magnetic actuator alters the position of the movable substrate with respect to the fixed substrate. The magnetic actuator comprises a magnetic driver having a continuous strip of HTS material on an upper surface of the fixed substrate. Note that as used herein, a "continuous strip of HTS material" will include within its scope a strip of HTS material that may be, interrupted by segments of non-HTS materials such as normal metals used in overcrossings. A lower surface of the movable substrate opposes the upper surface of the fixed substrate. On the lower surface, the magnetic actuator includes an HTS reaction plate substantially overlapping the magnetic driver whereby a tuning current flowing through the continuous strip of HTS material produces a repulsive force between the magnetic driver and the HTS reaction plate.

In one embodiment, the circuit includes a split-plate variable capacitor. The variable capacitor comprises a first capacitor plate and a second capacitor plate on the upper surface of the fixed substrate and a floating capacitor plate on the lower surface of the movable substrate that substantially overlaps the first and second capacitor plates wherein the first and second capacitor plates opposing the floating capacitor plate define a gap of the variable capacitor. As current flows through the magnetic driver, the repulsive force induced between the magnetic driver and the HTS reaction plate changes the capacitor gap, thereby varying the capacitance of the variable capacitor.

In another embodiment of the invention, the circuit includes a variable inductor. The variable inductor comprises an HTS inductor on the upper surface of the fixed substrate and an HTS inductance suppression plate on the lower surface of the movable substrate that substantially overlaps the HTS inductor.

A restoring force that opposes the force produced by the magnetic actuator may be provided by a first and a second membrane attached to a first and second end of the movable substrate, respectively. The first membrane connects the first end of the movable substrate to a first post on the upper surface of the fixed substrate, the first post being laterally disposed to the first end of the movable substrate. Similarly, the second membrane connects the second end of the movable substrate to a second post on the upper surface of the fixed substrate, the second post being laterally disposed to the second end of the movable substrate.

The force generated by the magnetic actuator that moves the movable substrate with respect to the fixed substrate may be either a "push" (repulsion only) or a "push-pull" (repulsion/attraction) type force. In embodiments of the invention in which the HTS reaction plate has neither any trapped magnetic flux nor any permanent magnets, the magnetic actuator is a push magnetic actuator. HTS reaction plates for a push magnetic actuator are preferably solid plates. In a push-pull magnetic actuator, the actuator may include trapped circulating supercurrents within the HTS reaction plate to generate an attractive magnetic force that interact with the driver current in such a way as to produce, for one direction of driver current, an enhanced repulsive force, while for driver currents within a certain range of magnitude in the opposite direction, an attractive force is created between the driver and this "poled" reaction plate. This attractive magnetic force would, if otherwise unopposed by application of spring-like mechanical restoring force, tend to draw the movable substrate towards the fixed substrate. Suitable HTS reaction plates for a push-pull magnetic actuator preferably comprise at least one concentric closed loop of HTS material and may conveniently be referred to as a "poled" HTS reaction plate, in analogy with terminology used for ferromagnetic or ferroelectric devices. Circulating supercurrents that are held within the "poled" HTS reaction plate generate a magnetic flux that has a component parallel to the plate. This field component may produce an attractive "pull" force between the reaction plate and the driver coil if the driver current is in the correct polarity and magnitude, thus providing the "pull" within a push-pull magnetic actuator. Alternatively, conventional permanent magnet material poled to attract the magnetic driver could be incorporated into the movable substrate adjacent the HTS reaction plate to provide a push-pull magnetic actuator.

The present invention also includes methods of inducing the circulating supercurrents within a "poled" HTS reaction plate of a push-pull magnetic actuator. In one method, the magnetic driver is cooled below its critical temperature while the HTS reaction plate is above its critical temperature and the HTS reaction plate and the magnetic driver are in close proximity. A drive current is then induced in the magnetic driver while the HTS reaction plate is cooled below its critical temperature, thereby inducing the circulating supercurrents within the continuous strip of HST material to "pole" the "poled" HTS reaction plate. To assist cooling the magnetic driver below its critical temperature while the magnetic driver is in close proximity to a HTS reaction plate above its critical temperature, the magnetic driver may be constructed from HTS material that has a higher critical temperature than the HTS material used to construct the HTS reaction plate. Alternatively, both the magnetic driver and the HTS reaction plate may be brought below their critical temperatures. Then, a heat source above an upper surface of the movable substrate may generate radiant energy to briefly raise the HTS reaction plate above its critical temperature without raising the magnetic driver above its critical temperature while a drive current is applied to the magnetic driver coil.

An alternative method does not require the application of a drive current through the magnetic driver. Instead, both the magnetic driver and the HTS reaction plate are cooled below their critical temperatures. Then, a high intensity pulsed magnetic field aligned normally to the lower surface of the movable substrate would be applied to induce the circulating supercurrents within the continuous strip of HTS material to ("pole") the "poled" push-pull driver reaction plate.

In an another embodiment of the invention, opposing push magnetic actuators are used to provide a "push-pull" operation despite the absence of a push-pull magnetic actuator. In one embodiment, the movable substrate lies between opposing surfaces of the fixed substrate wherein the opposing surfaces of the fixed substrate are spaced apart a distance greater than the thickness of the movable substrate, thereby allowing translational movement of the movable substrate between the opposing surfaces. A first magnetic actuator comprises a magnetic driver on one of the opposing surfaces of the fixed substrate. A first HTS reaction plate on the surface of the movable substrate opposing the first magnetic driver substantially overlaps the first magnetic driver. A second magnetic actuator comprises a magnetic driver on the other of the opposing surfaces of the fixed substrate. A second HTS reaction plate on the surface of the movable substrate opposing the second magnetic driver substantially overlaps the second magnetic driver, whereby the second and first magnetic actuators produce opposing forces on the movable substrate. Alternatively, a single HTS reaction plate on one of the sides of the movable substrate may be used to generate the repulsive reaction forces from both the first magnetic driver and the second magnetic driver.

In an another embodiment, the movable substrate is suspended on a torsionally compliant fiber or band. The torsion fiber attaches to and extends across the upper surfaice of the movable substrate. Preferably, the torsion fiber is positioned on a centerline of the movable substrate such that, absent additional forces, the lower surface of the suspended movable substrate is parallel to the upper surface of the fixed substrate. The torsion fiber may be attached to posts on the fixed substrate that are laterally disposed to the movable substrate. A first and a second magnetic actuator are located on opposite sides of the torsion fiber. Rotational motion of the torsionally suspended movable substrate is induced in one direction when current is passed through the driver coil on one side of the torsion fiber axis, and in the opposite direction when the current is passed through the opposing driver on the other side of the rotational axis. In a preferred embodiment, to allow a greater tuning range, the movable substrate comprises a first and a second planar portion attached to each other in a dihedral configuration, the torsion fiber axis being located near the apex of the dihedral angle. This dihedral angle allows the rotational axis of the movable substrate to be placed very close to the fixed substrate, while still permitting rotation of the movable substrate by an angle slightly greater than the dihedral angle without either of the sides of the movable substrate striking the fixed substrate. The dihedral configuration allows a planar portion of the movable substrate to go from a tuning position parallel to, and in very close proximity to, the fixed substrate, to a rotated position in which the end of the planar portion is a comparatively large distance from the fixed substrate (and angled away from it by the dihedral angle). This enables a very large tuning range to be achieved in either capacitive or inductive tuning (or combinations of these in complex resonator structures). In an alternate embodiment, the movable substrate comprises a first planar portion and a second planar portion wherein the first and second planar portions are joined with a lap joint. The torsion fiber would attach to the movable substrate adjacent the lap joint.

While the use of a rotationally compliant torsion fiber or band suspension has been described here, a number of different mechanical means to constrain the position of the axis of rotation of the movable substrate to obtain very low friction and backlash (hysteresis), and nearly-pure rotational motion of the movable substrate could be utilized in this embodiment of the invention. These include a fulcrum or knife edge on the movable substrate working against a flat surface, or a groove or other suitable positioning structure on the fixed substrate, a fulcrun or knife edge on the fixed substrate working against a flat surface, or a groove or other suitable positioning structure on the movable substrate, or the combination of one of these with a torsion fiber or band to assist in maintaining proper positioning of the movable substrate and its rotational axis.

BRIEF DESCRIPTION OF THE DRAWINGS

FIG. 6 is a plan view of the planar driver coil and reaction plate for a "push" magnetic actuator and a "push-pull" magnetic actuator.

DETAILED DESCRIPTION OF THE INVENTION

Figure 1A:
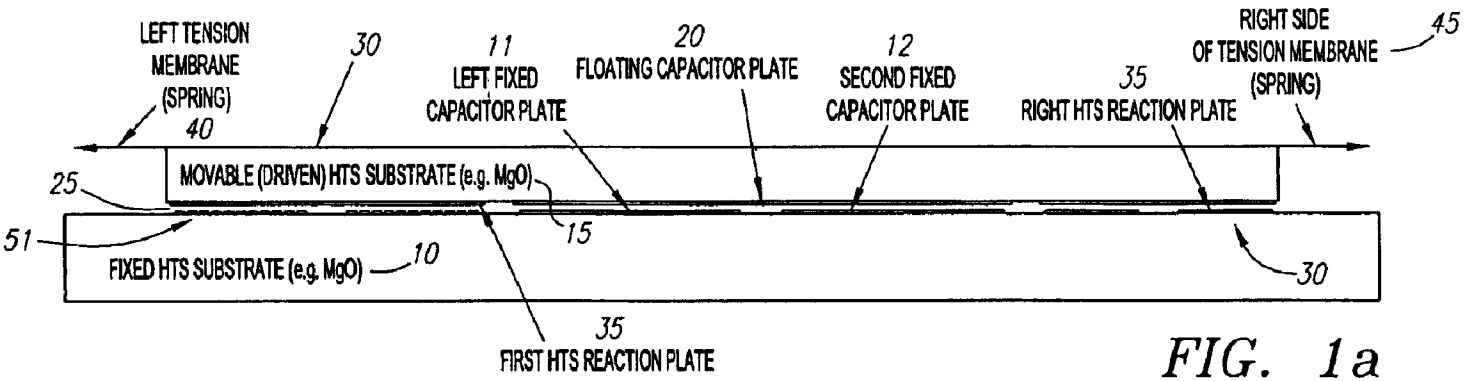
FIG. 1*a* is a cross-sectional view of a parallel split-plate capacitor tuned by a pair of magnetic actuators having single-pole magnetic drivers according to one embodiment of the invention.
Figure 1B:
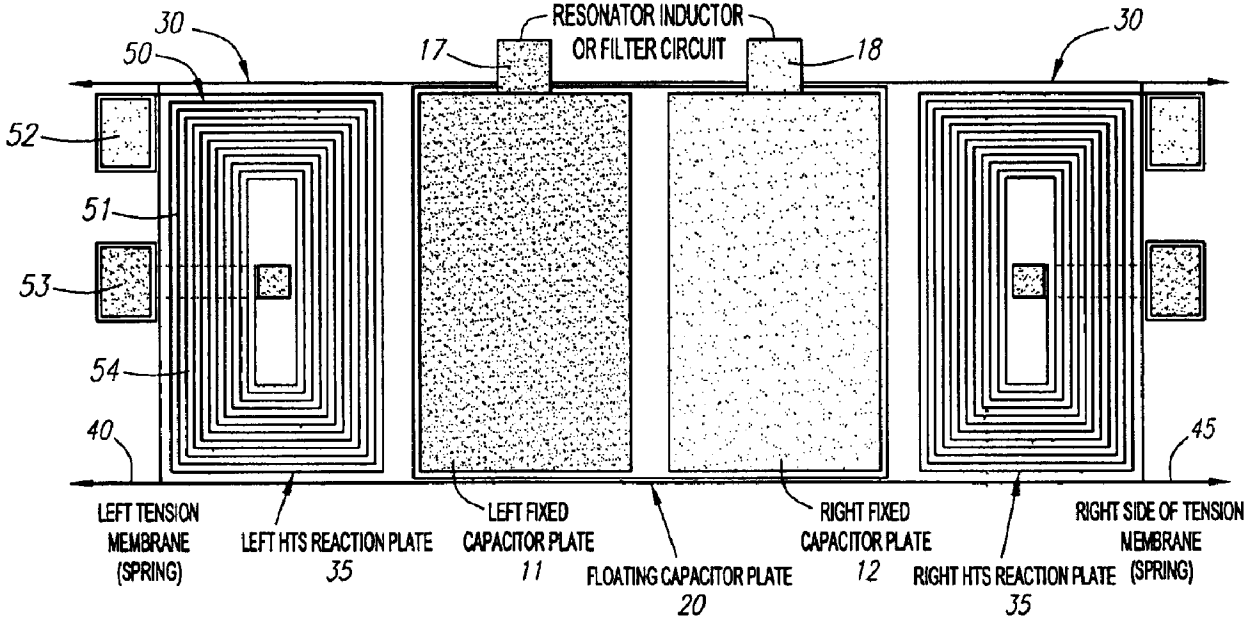
FIG. 1*b*. is a plan view of the parallel split-plate capacitor of FIG. 1*a*, partially cut-away.
Figure 1C:
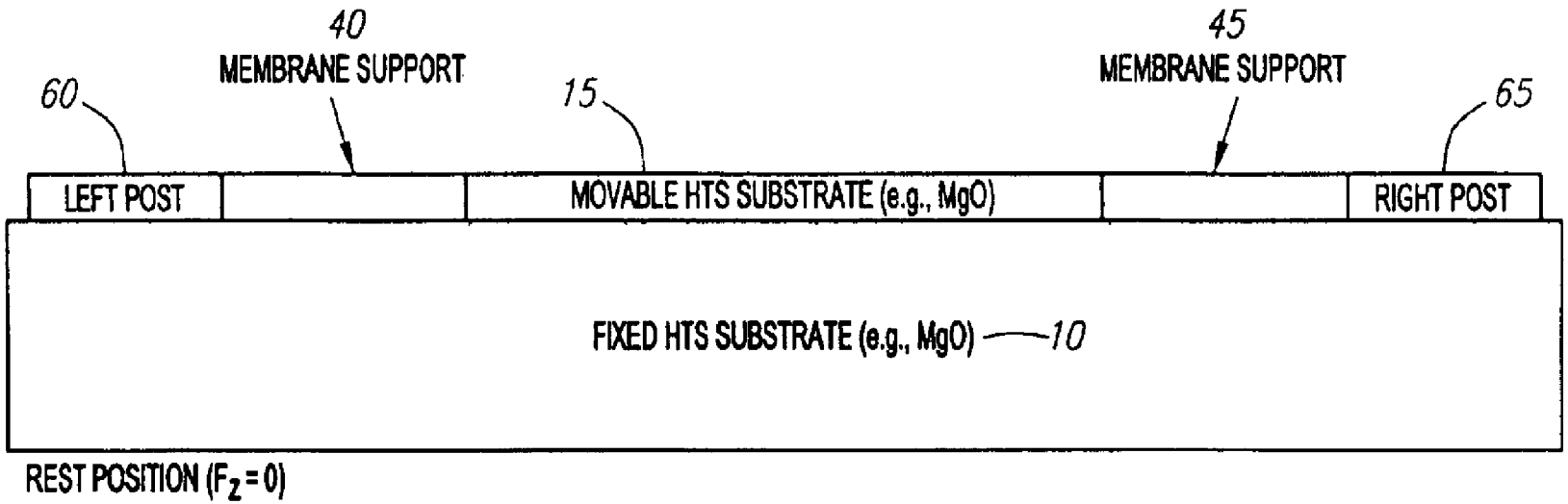
FIG. 1*c* is a cross-sectional view of the parallel split-plate capacitor of FIG. 1*a*, illustrating a pair of posts for supporting the first and second membranes.

The present invention provides a magnetic actuator for varying the electrical characteristics of variable capacitors or inductors. The magnetic actuator of the present invention has a dramatically greater tuning range than the electrostatic drivers of conventional prior art MEMS variable capacitors. Turning now to FIGS. 1*a* through 1*c*, a variable parallel split-plate capacitor tuned by a pair of magnetic actuators with a movable substrate 15 having a membrane-suspended vertical translational geometry is illustrated. The variable capacitor comprises a fixed substrate 10 (illustrated in FIGS. 1*a* and 1*c*) suitable for carrying an HTS layer. Suitable materials for the fixed substrate 10 include MgO. On the upper surface of the fixed substrate 10, a first fixed capacitor plate 11 and a second fixed capacitor plate 12 are formed using thin-film HTS material. Such epitaxial superconductive thin films are now routinely formed and commercially available. See, e.g., R. B. Hammond, et al., "Epitaxial $Tl_2Ca_1Ba_2Cu_2O_8$ Thin Films With Low 9.6 GHz Surface Resistance at High Power and Above 77K", Appl. Phy. Lett., Vol. 57, pp. 825–27, 1990. Adjacent to the fixed substrate 10 is a movable substrate 15 (drawn transparent in the plan view of FIG. 1*b*) wherein the movable substrate 15 also comprises a material such as MgO suitable for deposition of an HTS layer. The variable capacitor structure is completed by the addition of a floating capacitor plate 20 (illustrated in FIGS. 1*a* and 1*b*) on the lower surface of the floating plate 15 using thin-film HTS material. Floating plate 20 is spaced apart and substantially parallel to the first and second fixed plates 11 and 12 and may completely cover the fixed plates 11 and 12 (thus forming a parallel split-plate capacitor structure). As a result, the HTS variable capacitor structure actually comprises two variable capacitors in series, which halves the capacitance per unit are over that of a normal parallel plate capacitor structure. The advantage is that no conductive contact to the floating capacitor plate 20 is required, a feature that greatly simplifies (particularly for an HTS implementation) the achievement of very low series resistance contact to the capacitor, thereby producing a higher Q. In such an embodiment, an input signal need be coupled only to the first and second fixed capacitor plates 11 and 12 through a pair of signal leads 17 and 18.

A pair of magnetic actuators 30 (illustrated in FIGS. 1*a* and 1*b*) varies the capacitance of the variable capacitor by increasing or decreasing a gap 25 between the floating capacitor plate 20 and the first and second fixed capacitor plates 11 and 12. The magnetic actuators 30 of the present invention utilize the property that a superconducting material cannot support either an electric or magnetic field within the bulk of the HTS material. If, for example, an electric field were impressed within a superconducting material, Ohm's law would demand an infinite current because the superconductor has no resistance. Conductors subject to an impressed magnetic field experience an induced electric field strength proportional to the rate of change of the magnetic field strength in the material, which generates a transient current in the material whose magnitude and duration depend on the conductivity. In a superconductive material, the dc conductivity is infinite so that the duration of this transient current is infinite ("persistent" current). Because no magnetic flux can penetrate deeply into the superconductor, the persistent induced currents in the HTS material will flow in such a pattern as to ensure that this is the case. Thus, superconducting materials subject to an impressed field will generate "mirror" currents producing a mirror field such that the impressed field is opposed by the mirror field within the superconductor material, thereby avoiding the unnatural result of an infinite current. The magnetic actuators 30 exploit this property by generating a magnetic flux which causes a magnetic pressure to be exerted on HTS reaction plates 35 (illustrated in FIGS. 1*a* and 1*b*) on the lower surface of the movable substrate 15. This magnetic pressure or force may be opposed by a restoring spring force generated by a first and a second membrane 40 and 45 attached to either end of the movable substrate 15 (the weight of the movable substrate 15, assuming a vertical geometry, would also provide a restoring force) that would otherwise keep the gap 25 at a minimum value.

To generate the magnetic force, each magnetic actuator 30 has a magnetic driver 50 comprising a continuous strip 51 of HTS material deposited on the upper surface of the fixed substrate 10. As illustrated in FIG. 1*b*, the continuous strip 51 of HTS material is preferably arranged in a spiral drive coil. Note that as used herein, a "continuous strip of HTS material" will include within its scope a strip of HTS material that may be interrupted by segments of non-HTS materials such as normal metals used in overcrossings. In fact, the functionality of the invention would be the same whether this drive coil is a continuous superconductor, superconductor segments interspersed with normal metal segments (such as the overcrossing 54 from the center of the coil to the outside in FIG. 1*b*), or entirely fabricated from normal metal. However, the substantial drive current power from a drive coil fabricated entirely from normal metal could, in most applications, cause a heat load sufficient to raise the device temperature and cause the HTS materials in the reaction plates and signal elements to be degraded, or to "go normal" entirely. This power dissipation problem is eliminated by having the drive coil(s) fabricated principally (or entirely) of HTS material.

An applied DC tuning current through the drive coil or continuous HTS strip 51 generates the repulsive magnetic force between the magnetic driver 50 and the HTS reaction plate 35. This repulsive magnetic force causes the gap 25 to increase by an amount determined by the applied tuning current, $I_d$, the effective restoring spring constant produced by the first and second tension membranes 40 and 45, and the details of the magnetic field produced by the applied tuning current through the continuous strip 51. The details of the magnetic field will depend upon the arrangement of the continuous strip 51. In a preferred embodiment, the strip 51 will be arranged into a planar spiral drive coil or other arrangements possessing a line of symmetry. As used herein, the magnetic driver 50 is denoted a single pole driver, if on one side of the line of symmetry, the current through the sections of the strip 51 all flow in the same direction. In each magnetic driver 50 of FIG. 1*b*, the continuous strip 51 forms a single pole planar rectangular "spiral" coil using a single layer of HTS material. The rectangular spiral coil is excited through leads 52 and 53 (illustrated in FIG. 1*b*). Because the rectangular spiral coil is planar, the inner end of the coil must couple to lead 53 through an overcrossing (or possibly undercrossing) 54 formed in a second conductor layer on the fixed substrate 10. As noted above, this second conducting layer from which the overcrossing 54 is fabricated can be of normal metal if desired.

As illustrated in FIG. 1*a*, the continuous strip 51 is formed from a single HTS layer. The use of multiple (two or more) HTS layers in the magnetic driver 50 would increase the forcetcurrent sensitivity of the drivers if these benefits were judged to offset the added HTS technological complexity. It is to be noted that in the embodiment illustrated in FIGS. 1*a* and 1*b*, the reaction plates 35 may be solid plates similar to the plates used for the capacitor plates 11, 12, and 20. Such reaction plates will only oppose the magnetic flux created by the drive coils 50. Thus, the magnetic actuators 30 may be denoted as "push" magnetic actuators. In other embodiments of the invention discussed herein, the solid reaction plates 35 are altered whereby magnetic flux trapped in the reaction plate allows either a repulsive force or an attractive force to be created between the reaction plate and the drive coil—such embodiments of the magnetic actuators may be denoted "push-pull" actuators.

In the membrane-suspended geometry for the HTS tunable filter device structures of FIGS. 1*a* through 1*c* having push-type magnetic actuators 30, any generated magnetic pressure is, in steady state, counterbalanced by the sum of the gravitational force on the movable substrate 15 (unless the plane of the movable substrate is exactly vertical, in which position this force is zero) plus the restoring spring force which is provided by the first and second tension membranes 40 and 45 extending from either end of the movable substrate 15 to posts 60 and 65 mounted on the fixed substrate (illustrated in FIG. 1*c*). To ensure that the tension membranes 40 and 45 return the movable substrate 15 to the fixed substrate 10 in the absence of any tuning current in the magnetic driver 50, the posts 60 and 65 may be made slightly shorter than the thickness of the movable substrate 15, thereby achieving adequate response times, even in inverted operation such that gravity would tend to pull the movable substrate 15 apart from the fixed substrate 10. Applying current through the magnetic drivers (which would ordinarily be connected in series as illustrated in FIG. 10*b*) creates a repulsive force which, if of adequate magnitude, will overcome the "spring" tension of the first and second tension membranes 40 and 45 and the weight of the movable substrate 15, thereby increasing the gap 25 to a given length z.

Figure 2:
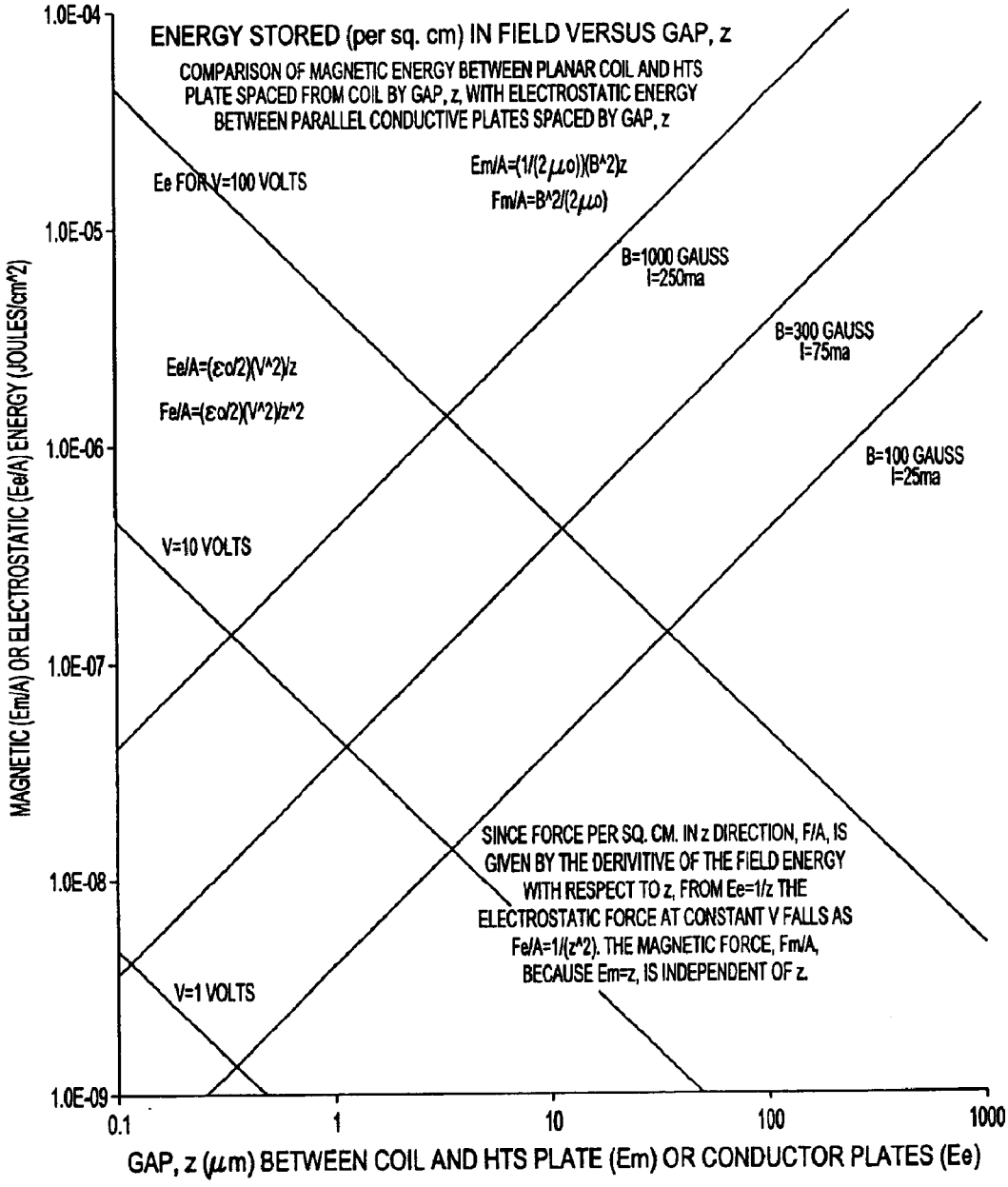
FIG. 2 is a graph comparing the stored energy (electrostatic or magnetic) vs. gap characteristics of prior art parallel plate electrostatic drivers and a magnetic driver of the present invention having constant field strength over the gap.

The striking differences between the forces produces by conventional electrostatic drivers for a MEMS capacitor versus those produced by the magnetic actuators of the present invention may be illustrated with reference to FIG. 2. FIG. 2 represents the energy stored (per square centimeter of capacitor plate area) in both a conventional electrostatic MEMS driver and the magnetic actuator of the present invention with respect to the gap distance z defined between the capacitor plates. More specifically, FIG. 2 shows the energy stored (per centimeter squared) in a conventional electrostatic MEMS driver with respect to the gap distance z ($\mu$m) for voltage differences V of 1 Volts, 10 Volts and 100 Volts between capacitor plates. FIG. 2 also shows the energy stored (per centimeter squared) in the magnetic actuator of the present invention with respect to the gap distance z ($\mu$m) for magnetic field strengths B of 100 Gauss, 300 Gauss and 1000 Gauss. For an electrostatic driver consisting of two parallel conductive plates separated by a gap, z, the stored electric field energy, $E_e$, (ignoring fringing) per unit area A between the plates having a voltage difference, V, will be given by $$E_e/A=(\epsilon_0/2)\epsilon^2 z=(\epsilon_0/2)(V/z)^2\ z=(\epsilon_0/2)V^2/z \qquad \text{(Eq. 5)}$$

where $\epsilon_0=8.854\times10^{-12}$ Farad/meter (F/m) is the permittivity of a vacuum and $\epsilon=V/z$ is the field strength. Note that the total electrostatic stored energy $E_e$ falls off as 1/z as the gap size z is increased. The normal (z-direction) force per unit area, $F_e/A$, between the plates is just the derivative of $E_e/A$ with respect to the gap z, or $$F_e/A=d(E_e/A)/dz=-(\epsilon_0/2)(V/z)^2 \qquad \text{(Eq. 6)}$$

where the negative sign (from $d(1/z)/dz=-1/z^2$) corresponds to an attractive force between the capacitor plates.

The extremely rapid fall off (as $1/z^2$) of electrostatic force vs. the gap length z contrasts dramatically with the force profile of the present invention. Consider the magnetic drivers 50 of FIG. 1*b* each comprised of a continuous strip of HTS material 51 forming a closely spaced rectangular "spiral" coil. Within the coil, each section of the continuous strip 51 carries an identical current, $I_d$, spaced by a gap z from the HTS reaction plates 35. The HTS continuous strip 51 is coiled according to a pitch, P, which is defined as the center-to-center distance between the sections of the coil. For a gap z larger than half of the conductor pitch P (i.e., for z>P/2), the magnetic field B in the gap 25 will be approximately parallel to the (planar) magnetic driver 50. Effectively, with this limitation on the pitch, the rectangular spiral coil within the magnetic driver 50 acts as a closed-loop uniform current sheet. When the lateral dimensions of the magnetic driver 50 are much larger than the gap 25, the magnetic field strength, B, in the gap 25 is essentially uniform and hence the (per unit volume) energy density (B·H/2) gives a per unit area magnetic energy density, $E_m/A$, of $$E_m/A=(B\cdot H/2)z=(1/2\mu_o)B^2 z \qquad \text{(Eq. 7)}$$

where $\mu_o=4\pi\times10^{-7}$ H/m. Note that the total energy stored in the magnetic field per unit area $E_m/A$ increases in proportion to z as the gap size is increased. The normal (z-direction) force per unit area, $F_m/A$, between the planar coil in the magnetic driver 50 and the HTS reaction plate 35 is just the derivative of $E_m/A$ with respect to the gap length z, or $$F_m/A=d(E_m/A)/dz=(1/2\mu_o)B^2 \qquad \text{(Eq. 8)}$$

which means that the repulsive force is independent of the gap z (ignoring fringing, which will be true for gaps z substantially smaller than the lateral dimensions (e.g., radius) of the planar coil and HTS reaction plate 35). Thus, the magnetic driver of the present invention will provide a uniform force over a large range of gap displacements.

The energy approach just discussed gives a very good estimate for the magnetic repulsive force for gap values greater than the pitch P, but substantially smaller than the overall lateral dimensions of the magnetic drivers and HTS reaction plates. For a magnetic driver having a single-layer planar coil, the wire pitch P (which is defined as the center-to-center distance between adjacent sections of the continuous strip of HTS material) will be the sum of the HTS section width, w, plus the spacing dimension, s, between adjacent sections. For example, P=4.0 $\mu$m for w=2.0 $\mu$m and s=2.0 $\mu$m. Since typical thickness values, $t_m$, for commercially grown HTS layers are $t_m$=1.0 $\mu$m, a continuous strip of HTS material with a w=2.0 $\mu$m and an s=2.0 $\mu$m represents a lithographically reasonable objective for fineline fabrication. These dimensions result in conductor sections having a cross-sectional area, $A_c$, =2 $\mu$m×1 $\mu$m=$2\times10^{-12}$ $m^2$=$2\times10^{-8}$ $cm^2$. If the maximum allowable current density, $J_{max}$, in the HTS material is $J_{max}=5\times10^6$ a/$cm^2$, then the maximum conductor current would be $(I_d)_{max}$=100 milliamperes (ma). If a much more conservative $J_{max}=1.25\times10^6$ a/$cm^2$ value were assumed, then the maximum conductor current would be assumed to be $(I_d)_{max}$=25 ma.

Application of a current $I_d$ to each conductor section in an array of N parallel conductors (with all currents in the same direction) having a conductor pitch P and hence an array width W=NP, gives an effective current sheet of linear current density, $I_d/W$, given by $$I_d/W=NI_d/W=NI_d/NP=I_d/P\text{[amperes per meter]} \qquad \text{(Eq. 9)}$$

In turn, the transverse magnetic field, $H_r$, near an isolated array of conductors or a current sheet will have a magnitude (in amperes/meter or ampere-turns/meter) of $$H_r=(\text{ampere turns}[MMF])/(\text{flux path length})=NI_d/2W=I_d/(2P) \quad \text{(Eq. 10)}$$

(since the shortest flux path length around a sheet of width W is 2W). The notation $H_r$ is used for this transverse magnetic field, since is perpendicular to the axial $H_z$ field that is usually of interest in coils (e.g., for calculating solenoid inductance, etc.). In usual practice, such a parallel array of conductors is bent around back on itself in the plane of the conductors to form a planar coil such as a planar spiral inductor when bent into a circle. In this way the current from one turn is reused in the next, etc., so the terminal current required to produce N $I_d$ ampere turns of MMF is only $I_d$ amperes.

In the example of FIGS. 1*a*–1*c*, and the other embodiments illustrated herein, this "bending" is accomplished with four 90° corners to make a rectangular or square planar "spiral inductor", the behavior of which is very similar to that of a true circular spiral of the same area. The invention includes within its scope, however, any configuration of the continuous strip within the magnetic driver that produces a sufficient magnetic force between the driver and the reaction plate such that the movable substrate moves with respect to the fixed substrate. A magnetic driver having one planar coil structure of this spiral type (i.e., one in which all of the conductor sections on one side of a plane of symmetry through the coil carry current in the same direction) will be referred to herein as a single-pole driver. The planar coil of the magnetic driver is near the plane of the HTS reaction plate. The effect of the current flow (supercurrent) rejecting flux penetration through this HTS plane can be viewed as creating a mirrored image of the coil on the other side of the HTS plane. That is, if the planar coil is carrying current N $I_d$ with the HTS reaction plate a distance z from the coil, then the effect is the same as if another coil spaced a distance 2z from the coil were carrying a current −N $I_d$. The magnetic fields $H_r$ from these two coils add, making the magnetic field, $H_{rgap}$, in the gap between the coil and the HTS reaction plate to be given by $$H_{rgap}=H_r+H'_r=NI_d/W=I_d/P \quad \text{(Eq. 11)}$$

where the "prime" on $H'_r$ is to denote the magnetic field contribution from the "mirrored" coil on the other side of the HTS reaction plate (i.e., that due to the supercurrent flowing in the HTS reaction plate). The magnetic flux density, $B=B_r$, generated in the gap between the planar coil and the HTS reaction plate will be given (for a relative permeability of $\mu_r=1$)

$$B_{rgap}=\mu_o H_r=\mu_o I_d/P \quad \text{(Eq. 12)}$$

which leads to, for gaps z greater than P/2, a repulsive force per unit area, $F_m/A$, between a single pole coil and the HTS reaction plate of $$F_m/A=(1/2\mu_o)B_{rgap}^2=(\mu_o/2)I_d^2/P^2 \quad \text{(Eq. 13)}$$

It is instructive to look at the magnitude of these magnetic flux densities and forces in practical cases of interest for HTS magnetic actuators. Table 1 illustrates typical design parameters under two sets of design rules; one "conservative," and the other "more aggressive" with respect to the coil current density $J_{max}$, conductor section spacing s, and the thickness of the movable substrate, $t_{ms}$.

TABLE 1

Examples of HTS Driver Design Parameters

| Current Density & Lithographic Design Rules: | Conservative | More Aggressive |
|---|---|---|
| Conductor Current Density, $J_{max}$ (amps/cm$^2$) | $1.25 \times 10^6$ | $5.0 \times 10^6$ |
| Conductor Layer Thickness, $t_m$ ($\mu$m) = | 1.0 | 1.0 |
| Conductor Width, w ($\mu$m) = | 2.0 | 2.0 |
| Conductor Spacing, s ($\mu$m) = | 2.0 | 1.0 |
| Conductor Pitch, P ($\mu$m) = | 4.0 | 3.0 |
| Maximum Conductor Current, $I_{max}$ (a) = $J_{max}$ ws = | 25 ma | 100 ma |
| Flux Density in Gap at I = $I_{max}$, $B_{rg}$ (Gauss) = | 78.5 Gauss | 419 Gauss |
| Drive Force per Unit Area, $F_m/A$ (newtons/m$^2$) = | 24.54 N/m$^2$ | 698 N/m$^2$ |
| Drive Force per Unit Area, $F_m/A$ (grams/cm$^2$) = | 0.25 g/cm$^2$ | 7.12 g/cm$^2$ |
| Resulting Movable Substrate Kinetics: | | |
| Thickness of Movable Substrate, $t_{ms}$ ($\mu$m) | 100 | 25 |
| Mass per sq. cm (at MgO density of 3.5837g/cm$^3$) | 0.0358 g/cm$^2$ | 8.96 mg/cm$^2$ |
| Max Acceleration of Movable Substrate, a = | 7.0 g's | 795 g's |
| Minimum Time to Move Δz = 10 $\mu$m (Rest to Rest), $\Delta t_r$ = | 764 $\mu$s | 71.6 $\mu$s |

From Table 1, it may be observed that a (very) conservative $I_d$=25 ma drive current with a P=4 $\mu$m conductor pitch gives a force, $F_m/A$=0.25 g/cm$^2$, for a maximum acceleration of a=7.0 g's (68.45 m/s$^2$) of a $t_{ms}$=4 mil (100 $\mu$m) thick MgO substrate (ignoring any membrane "spring" or gravitational forces). Using a more aggressive $I_d$=100 ma drive current with a P=3 $\mu$m conductor pitch gives a $F_m/A$=7.12 g/cm$^2$, for a maximum acceleration of a=795 g's with a thinner, $t_{ms}$=1 mil (25 $\mu$m) thick MgO substrate.

The magnetic energy density approach to the calculation of the force achievable with an HTS magnetic driver used above has the simple elegance of energy difference calculations, along with their disadvantage of offering very little insight as to just how the force arises. Fortunately, it is not much more difficult to go back to Ampere's law, which relates the (using bold face for the vector quantities) force F on a conductor of length, l, carrying a current of magnitude, I (in the direction of the length vector, I), in a magnetic field B as $$\mathbf{F}=I\mathbf{l}\times\mathbf{B} \quad \text{(Eq. 14)}$$

Consider such a conductor running in the X-direction, spaced by a height, Z=z above a superconducting plane. The action of the superconductor in the Z=0 plane will be to support a current distribution such that no magnetic flux penetrates this plane, which is to say, $B_z$=0 at Z=0 (i.e., everywhere on the HTS plane). While the supercurrent distribution in the HTS plane to achieve this may be complicated, it is easy to see that its effect is exactly the same as if there were no HTS plane, but a conductor of the same length were placed an equal distance on the other side of the Z=0 plane, "mirroring" the original conductor, but carrying current in the opposite direction (−I). (If this is not immediately obvious, draw a mental cross-section picture looking in the X-direction, showing identical conductor centers at Y=0, Z=+/−z, with clockwise circular field lines around one and equal but counterclockwise field lines around the other conductor. Where these intersect on the Z=0 plane, the transverse, $B_y$, field components add, but the vertical, $B_z$, components are equal but opposite, and hence cancel everywhere on the Z=0 plane.) This means that we can replace the HTS plane at Z=0 with an identical conductor, carrying −I, at the mirror image position, Z=−z, and have the same effect on forces, fields, inductances, etc. as the HTS plane has. This applies, by extension, to any number of conductors in any orientation, such as loops, coils, etc.

Consider the case of a planar array of conductors of length, $1=l_x$, carrying identical currents, I, having a pitch P at a height Z=z above the HTS plane (Z=0). While there is a Y-component of force causing the conductors to attract one another (we assume they are firmly mounted to the fixed substrate so no motion results from $F_y$), absent the nearby HTS plane, there would be no transverse component of magnetic field in the plane of the conductors (i.e., $H_r=H_x=H_y=0$ at Z=z without the HTS plane), which would mean (due to the cross-product in Eq. 14) that there could be no Z-component of force on the conductors. The $H_y$ transverse field component from all of these conductor currents does exist above and below the Z=z plane of the conductors, and in fact is just that given earlier in the equation for $H_r$. While the $H_y$ (or $H_r$ for radial) component in the Z=z plane containing the conductor array is zero because of symmetry ($H_y$ is changing sign from +I/(2P) to −I/(2p) right at Z=z), this is not the case when the symmetry is broken by the addition of the HTS plane at Z=0. The magnetic field from the conductor array mirrored at Z=−z indeed has a strong transverse, $H_y$, component, as described above. As a result, with the HTS plane present, there is a transverse, $B_y$, flux density at the Z=+z plane of conductors, given by $$B_y=\mu_o H_y=\mu_o NI/(2W)=(\mu_o/2)I/P \quad \text{(Eq. 15)}$$

From Eq. 14, the result of the $B=B_y$ magnetic flux density acting on a X-oriented wire of length $1=l_x$ carrying a current I will be a z-direction force, $F_z$, (per wire) given by $$F_z(\text{per wire})=(Il_x)B_y=(Il_x)I/P)=(\mu_o/2)l_x/p \quad \text{(Eq. 16)}$$

The total repulsive force between the N conductor array (whose width in the Y-direction is $W_y$=NP) and the HTS plane will be N times this, or $$F=F_z=N(\mu_o/2)1_x I^2/P=(W_y/P)(\mu_o/2)l_x I^2/P=(\mu_o/2)(W_y l_x/P^2 \quad \text{(Eq. 17)}$$

The quantity $W_y l_x$ is, of course, just the area A of the driver array, so the force per unit area, $F_z/A$, on the "coil" is given by $$F_z/A=(\mu_o/2)I^2/P^2(\text{For } z>P/2 \text{ and } D>>z) \quad \text{(Eq. 18)}$$

where D is the lateral dimension of the array. This is the same expression for force per unit area as derived using the field energy approach in Eq. 13.

More detailed analyses of the z-dependence of the single-pole force, as well as $F_m(z)$ for multi-pole driver "coils" (such as meander lines) in which not all of the conductor currents flow in the same direction can be based on the detailed conductor-to-conductor force relationship, and then summing these over all the conductors in the array. From Eq. 14, it can be shown that if two circular cross-section parallel wires of length l separated by a distance r carry currents $I_1$ and $I_2$ then the force per unit length, $F_{12}$, between them (using "−" sign for attractive force) is given by $$F_{12}/I=-(\mu_o/2\pi)(I_1 I_2)/r=-2\times10^{-7}(I_1 I_2)/r \quad \text{(Eq. 19)}$$

As noted previously, in a single-pole planar driver coil in a magnetic driver of the type illustrated in FIG. 1*b*, the currents in adjacent turns are equal and in the same direction, resulting in substantial attractive forces between the turns. But these attractive forces are only in the plane of the coil (transverse, or "radial" direction of a spiral), not in the vertical, Z-direction. On the other hand, the currents in the conductors "mirrored" at Z=−z on the opposite side of the HTS plane are in the opposite direction, $I_2=-I_1$, so the force will be repulsive, and, since the "mirrored" coil and the drive coil are not in the same plane, there will be a Z-component of this $F_{12}/l$ force. For a planar array of conductors in the coil carrying identical currents I at a pitch P, the Z-component of force on a conductor, i, is obtained from Eq. 18 by summing all of the contributions from each of the array conductors, j', "mirrored" in the HTS plane. For example, the force contribution to conductor i from its own image at Z=−z (or r=2z away from the conductor) will be purely vertical repulsive, and given by $$F_{zir}/l=(\mu_o/2\pi)I^2/(2z)=2\times10^{-7}I^2/(2z) \quad \text{(Eq. 20)}$$

The total Z-component of force on conductor i is obtained by summing the vertical components of force due to all of the mirrored conductors j' (including itself; the simple j'=i' case given in Eq. 20). This summed total force on conductor i is given by $$F_{zi}/1=\sum_{j'} I^2(\mu_o/2\pi)(2z)/\{(2z)^2+[(j'-i)P]^2\} \quad \text{Eq. 21}$$

Figure 3:
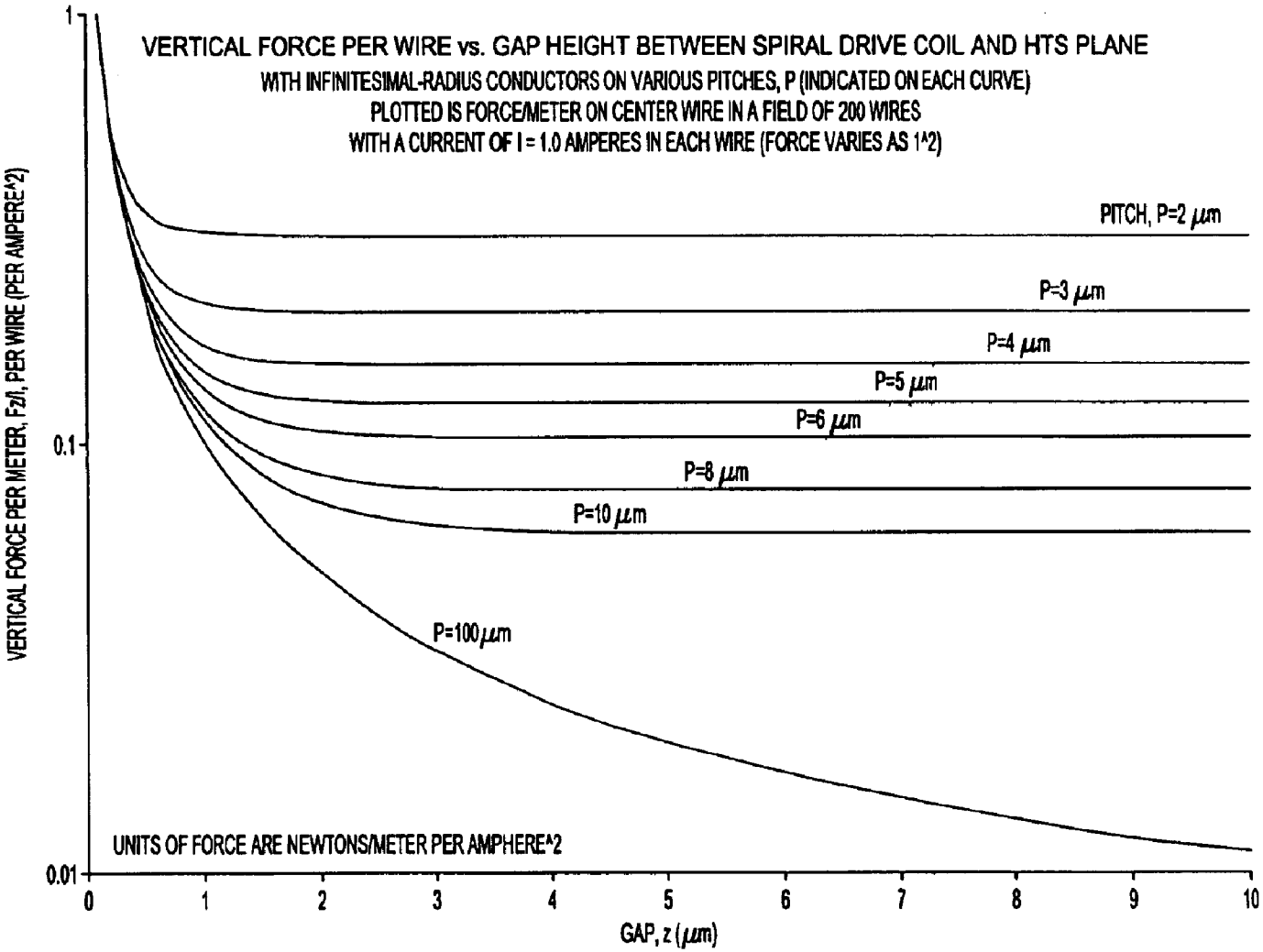
FIG. 3 is a graph comparing the force vs. gap characteristics of a single pole magnetic driver having various pitch values according to one embodiment of the invention.

All of the terms of this sum over j' are positive (repulsive force) if all of the currents in the conductor array are in the same direction (single pole magnetic driver). This type of sum calculation is easily carried out in a spreadsheet calculation (Microsoft Excel was used for most of the results shown here). FIG. 3 shows the force (per meter of wire length) on the center wire (the center section of the continuous strip of HTS material forming the planar spiral coil) in a field of 201 wires, all carrying unit current (I=1.0 ampere) in the same direction, versus the height, z, of this planar "coil" above the HTS plane, for various values of the wire pitch, P. This force is essentially constant for z>P/2, and in this "flat" region is inversely proportional to P with magnitude as given by Eq. 16 (with I=1 ampere and $l_x$=1 meter).

Figure 4:
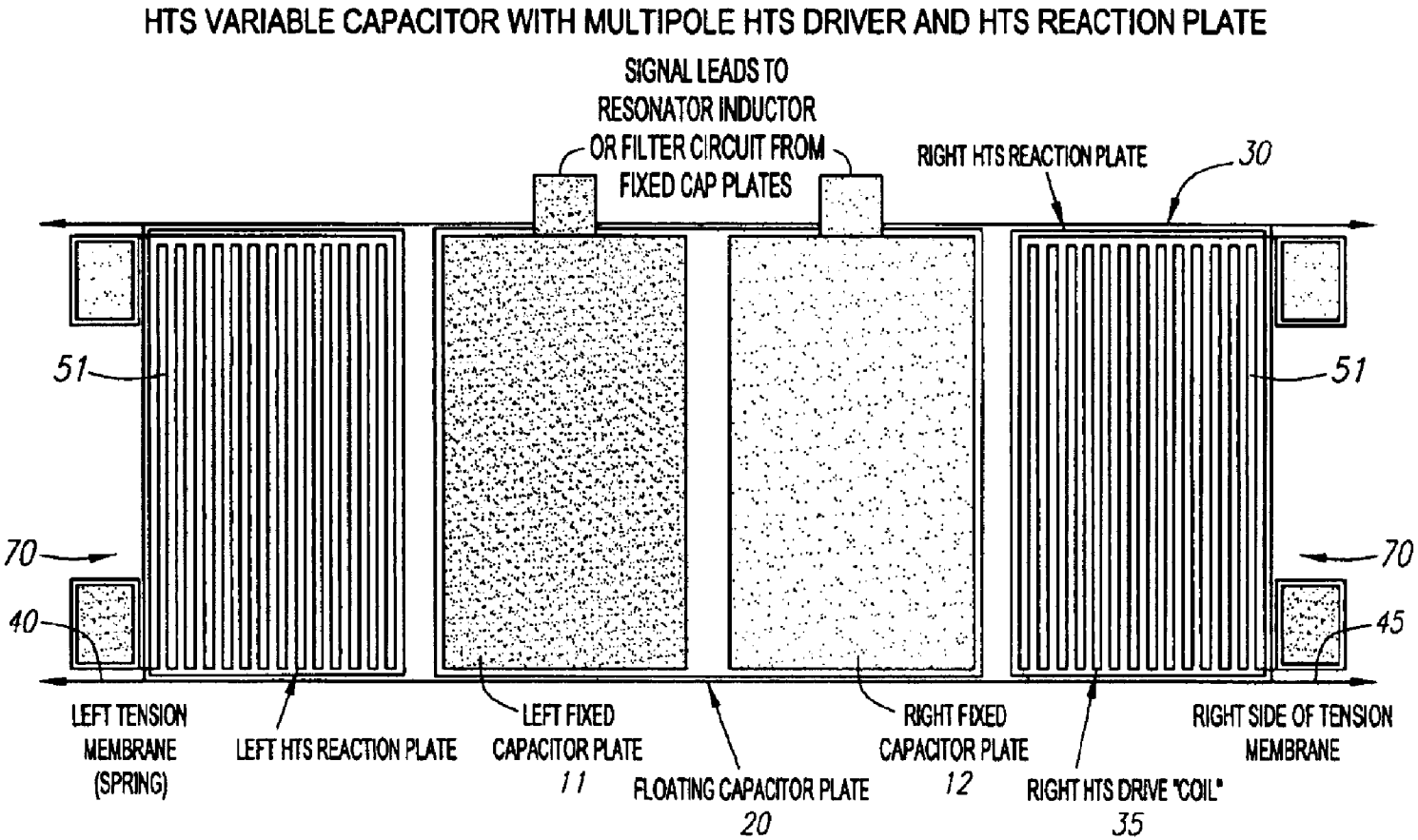
FIG. 4 is a plan view, partially cut-away, of a parallel split-plate capacitor tuned by a pair of magnetic actuators having multi-pole magnetic drivers according to one embodiment of the invention.
Figure 5:
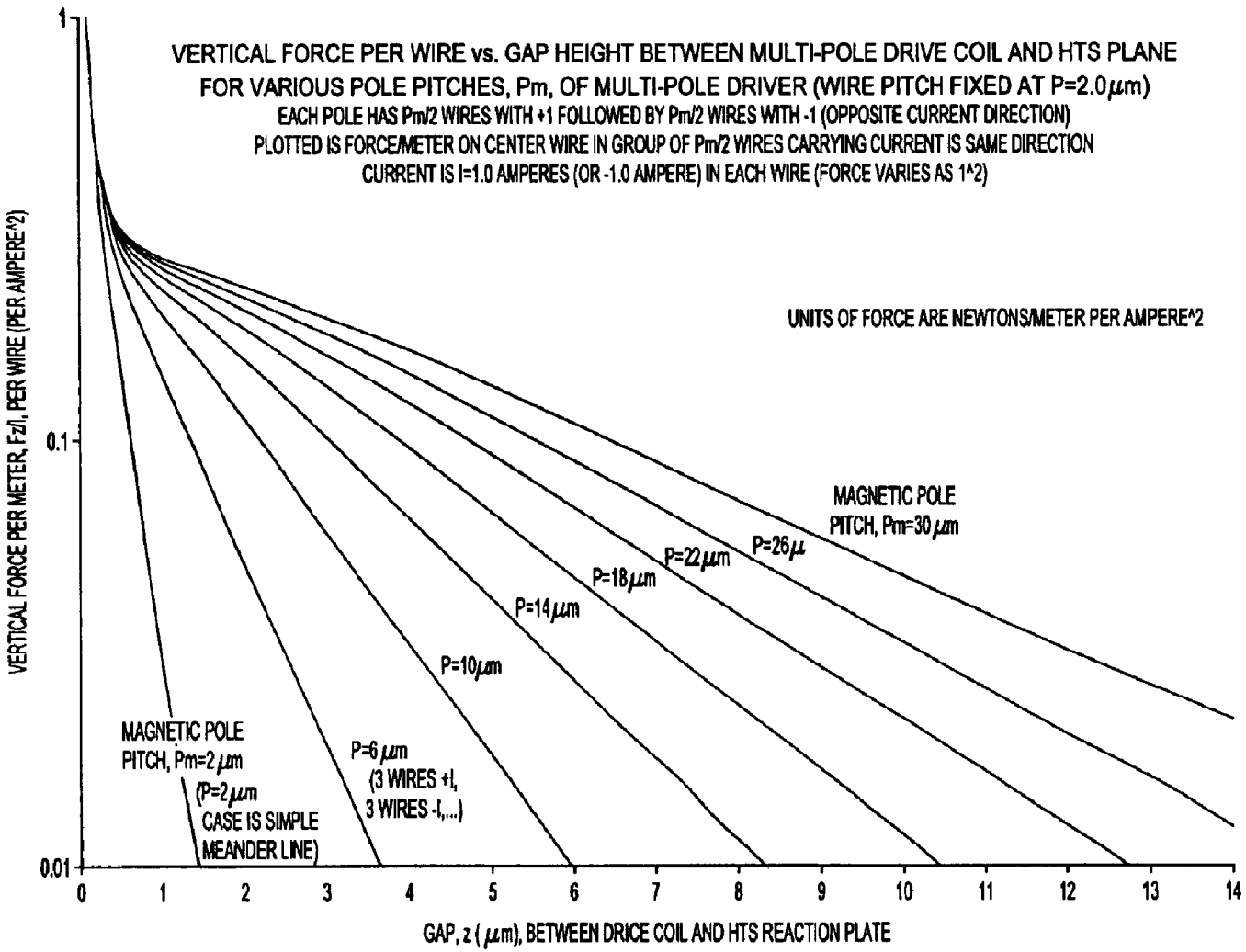
FIG. 5 is a graph comparing the force vs. gap characteristics of a multi-pole magnetic driver having various pole dimension values according to one embodiment of the invention.

For a multi-pole driver in which the current directions are reversed periodically, Eq. 21 is used, but it is necessary to keep track of the alternating signs of the terms in the sum. Turning now to FIG. 4, a pair of multi-pole magnetic drivers 70 is illustrated. With the exception of the configuration of the continuous strip 51 within the magnetic driver 70, the embodiment illustrated in FIG. 4 is identical to that illustrated in FIG. 1*b*. As used herein, if the continuous strip of a magnetic driver is arranged in a configuration having a line of symmetry and the current through parallel sections of the continuous strip on the same side of the line of symmetry travel in different directions, the magnetic driver is denoted a "multi-pole" driver. In the extreme multi-pole case of a meander line multi-pole magnetic driver, such as illustrated in FIG. 4, adjacent sections of the continuous strip of HTS material carry current traveling in opposite directions, which means that the j'=i term (Eq. 20) and all of the other terms for which (j'−i) is even are positive, but all of the terms in Eq. 21 for which (j'−i) is odd are negative. FIG. 5 shows a force vs. z plot similar to that of the single-pole case of FIG. 3, except that the currents are reversed in groups of wires in a multi-pole pattern. In all cases in FIG. 5, a basic wire pitch of P=2.0 $\mu$m is assumed, so that if all the currents were in the same direction, the $F_z(z)$ force would be the same as the top curve in FIG. 3, flattening off at a (per wire) value of 0.314 newtons/meter/ampere$^2$. The various curves in FIG. 5 correspond to different magnetic pole dimensions, $P_m$, where $P_m$ is the distance across the parallel conductors in the array before the current reverses sign. For example, in the simplest case of a meander line, as seen in FIG. 4, the current reverses every conductor, so for the P=2.0 $\mu$m wire pitch case illustrated, the magnetic pole pitch of a meander line is Pm=2.0 $\mu$m. Correspondingly, the $P_m$=6 $\mu$m curve in FIG. 5 is for a repeating pattern of three wires with +I followed by three wires with −I, etc., on to 15 wires with +I and 15 wires with −I for the $P_m$=30 $\mu$m curve. Of note is the fact that, other than for the $P_m$=2.0 $\mu$m case, all of the curves fall to about the same (per wire) force value ($F_z$0.0175 newtons/meter/ampere$^2$) at a "coil" height, z, above the HTS plane equal to half the magnetic pole dimensions $P_m$ (i.e., at $z=P_m/2$).

The rapid $F_x(z)$ fall-off of repulsive force with height, which is controllable by selecting the magnetic pole size $P_m$ could prove of substantial value in some driver applications, such as open-loop operation over a carefully controlled height range. (As used herein, open-loop operation refers to the use of a variable tuning current, $I_d$, through the planar driver coil to produce the desired gap, z, without the use of a height sensor element on the movable substrate to control z by means of a feedback control system.) For many applications, however, principal interest would be in achieving the greatest force over a large z motion range, for which simple single-pole drivers (spiral inductor-type coils) coils excel. For the remaining tunable filter element examples discussed below, single-pole magnetic drivers will be illustrated, but that is not to imply that the use of multi-pole driver configurations might not be more suitable in some applications.

It is important to point out one artifact in the $F_z(z)$ curves in FIGS. 3 and 5. The very rapid, 1/z, rise in $F_2(z)$ for z<0.5 $\mu$m is an artifact of the assumption of infinitesimal or very small circular cross-section to the conductor wires in the planar coil. In this assumption, the magnetic field, strength, $B_\theta(r)$, at radius r from the center of an isolated-conductor carrying a current I is given by $$B_\theta(r)=\mu_o I/(2\pi r)(\text{for } r>\text{conductor radius}) \quad \text{(Eq. 22)}$$

For an HTS magnetic driver, at very small gaps z, each conductor becomes very close to its own mirror image r=2z away, and hence sees a very large magnetic field $B_y=B_\theta(2z)$ from Eq. 22, leading to the 1/2z singularity of force, $F_{zii'}/I$, in Eq. 19 as z approaches zero.

In practice, the sections of the continuous HTS strip forming the planar coil in the magnetic driver may be lithographically patterned from deposited planar conductor layers, and hence tend to be of rectangular cross section, typically (as shown in Table 1) with a width w substantially greater than the thickness $t_m$. For an isolated rectangular conductor carrying a current I, the average magnetic field strength around the periphery of the conductor will be $$B_{Avg}\approx\mu_o I/(2w+2t_m)(\text{near surface of rectangular conductor}) \quad \text{Eq. 23}$$

While at large distances, r>>w, from the center of the rectangular conductor, Eq. 22 will approximate the field, for small gaps z, the field strength, and hence the repulsive force, does not increase as 1/(2z) as in Eqs. 22 and 20, but rather saturates toward a constant value.

The previous examples and performance analyses of all-HTS magnetic actuators for the implementation of variable reactive elements for tunable filters and other applications were based on the magnetic repulsion between a planar driver coil and a superconducting plate. However, it would be possible to implement such configurations using normal metal conductors, as long as ac drive currents, $I_d$, were used of a sufficiently high frequency that the skin depth in the reaction plate is substantially less than its thickness. If, however, a configuration using normal metal conductors was implemented using the "more aggressive" actuator design rules column from Table 1 with $t_m$=0.2.0 $\mu$m thick copper at a room temperature resistivity of 1.70 $\mu\Omega$-cm, the power dissipation in the coil, at I=100 ma would exceed 14 watts per square millimeter (actually well above this due to increased ac skin-effect conductor losses). The ac eddy current losses in the reaction plate would be only slightly less than this, and there is virtually no thermal conduction path away from the movable substrate to get rid of this heat. The previous examples and performance analysis of all-HTS magnetic actuators for the implementation of variable reactive elements for tunable filters and other applications were based on the magnetic repulsion between a planar driver coil and a superconducting plate. However, it would be possible to implement such configurations using normal metal conductors, as long as ac drive currents, $I_d$, were used of a sufficiently high frequency that the skin depth in the reaction plate is substantially less than its thickness. If, however, a configuration using normal metal conductors was implemented using the "more aggressive" actuator design rules column from Table 1 with $t_m$=2.0 $\mu$m thick copper at a room temperature resistivity of 1.70 $\mu\Omega$-cm, the power dissipation in the coil, at I=100 ma would exceed 14 watts per square millimeter (actually well above this due to increased ac skin-effect conductor losses). The ac eddy current losses in the reaction plate would be only slightly less than this, and there is virtually no thermal conduction path away from the movable substrate to get rid of this heat. Hence, the use of normal metal conductors for the drive coils and reaction plates, while theoretically possible for a repulsive driver, is thermally impractical.

A desirable characteristic for actuators would be a push-pull actuator technology. In a push-pull driver application, very little mechanical "spring" restoring force would be required, and it would be possible to pass substantial levels of drive current $I_d$ only when the position of the movable substrate is to be changed. (With minimal spring restoring force, closed-loop feedback stabilization of the position z of the movable substrate would be utilized. In such a configuration, higher levels of drive current would be dictated by the feedback control system only when substantial errors between the actual sensed position and the desired position of the movable substrate were sensed.) This approach would offer very low power dissipation in the control electronics (the power dissipation in the HTS drive coils and reaction plates being extremely small anyway), and potentially substantially less noise or fluctuations in movable substrate position, z, due to noise in the current drive electronics (fluctuations in z could translate into phase noise on signals). As will be discussed herein, it is possible to implement the effect of a push-pull driver mechanically, by means, for example, of locating drive coils on opposite sides of the HTS reaction plate on the movable substrate. Another embodiment of the invention utilizes a rotational approach, preferably implemented with a torsion suspension fiber or band suspending the movable substrate above the fixed substrate in a "teeter-totter" type of geometry, with a repulsion "push" driver under each end of the movable substrate on opposite sides of the suspension band. This type of "push-push" configuration may emulate the effect of a true repulsive-attractive "push-pull" driver, but requires additional mechanical and fabricational complexity.

Because of the unique characteristic of superconductors to sustain a supercurrent after the source that excited the supercurrent is removed, it is possible to reconfigure the reaction plate to enable a true "push-pull" repulsive-attractive HTS driver to be realized. If a superconducting loop contains an initial amount of magnetic flux, $\Phi_p$, such as flux present in the loop when it entered the superconducting state, the action of the superconductor will be to maintain the amount of enclosed flux constant at $\Phi_p$ thereafter.

A "push-pull" HTS driver approach utilizing this characteristic of superconductors to achieve a true repulsive-attractive magnetic force driver is illustrated in FIG. 6. Illustrated at the top of FIG. 6 is a "push" (repulsive) magnetic driver 50 with its solid HTS reaction plate 35. Since it starts, presumably, with no trapped flux, $\Phi_p=0$, the application of a given level of current, d, to the magnetic driver 50 in close proximity, Z=z, to the solid HTS reaction plate 35 generates an equivalent opposite ("mirror") supercurrent, $I_m$--$I_d$ in the HTS plane (wherein $I_m$ is defined as the equivalent current in the "mirror image" coil at Z=−z that produces the magnetic flux densities and $F_z(z)$ forces previously discussed). To implement a "push-pull" driver, the present invention-requires a reaction plate that is not only capable of supporting the $I_m=-I_d$ "mirror" currents, but is also capable of supporting stored flux levels, $\Phi_p$, as well. Shown at the bottom of FIG. 6 is an example of an HTS reaction plate 75 capable of doing this. This HTS reaction plate 75 is comprised of a series of concentric HTS loops 80 that generally match the pattern (i.e., general shape, not necessarily detailed pitch, etc.) of the loops in the matching drive coil. Because the conductor pattern in the HTS reaction plate 75 follows the direction of the sections of the HTS continuous strip 51 in the magnetic driver 50, it should efficiently support the $I_m=-I_d$ "mirror" current when a current, $I_d$, is passed through the magnetic driver 50. In addition, because the reaction plate is comprised of a plurality of concentric HTS loops 80, each one of which is capable of storing magnetic flux, $\Phi_p$, the reaction plate 75 should be capable of storing flux as desired for the "push-pull" driver.

Just as the easiest way to understand the behavior of the repulsive "push" magnetic driver is to replace the HTS reaction plate by the "mirror" coil at Z=−z from the planar coil in the magnetic; driver at Z=+z, the "mirror" coil behavior is the easiest way to look at this "push-pull" driver. The key difference in the ""push-pull" case is that the "mirror" current, $I_m$ is not simply the opposite of the drive coil current, $I_m=-I_d$, as it is in the "push", solid HTS reaction plate, case. Rather, in the presence of stored flux in the reaction plate, the "mirror" current $I_m$ will be given by $$I_m=I_p-I_d(\text{with stored flux in HTS plate}) \qquad \text{(Eq. 24)}$$

What Eq. 24 indicates is that in the absence of any driver current, $I_d$, there is still an equivalent current, $I_m=I_p$ in the "mirror" coil at −z. This quantity, $I_p$, is, of course, the effective value of the supercurrent required to maintain the magnetic flux trapped in the HTS reaction plate constant at its $\Phi_p$ initial value. It is useful to refer to $I_p$, as "poled current" in the HTS reaction plate, and the process of storing the magnetic flux, $\Phi_p$, in the plate as "poling", in analogy to the poling process of applying a strong electric field/temperature to a ferroelectric material to make it piezoelectric (as opposed to just electrostrictive). The poling process is used in a ferroelectric to break down the electric field directional symmetry. When the positive and negative electric field directions are indistinguishable, the elongation can only vary as the square of the electric field, analogous to the $I^2$ behavior of force for the "push" magnetic driver (e.g., Eq. 18). By creating a preferred direction of electric field, so that positive and negative field directions are discernable, the ferroelectric material may become piezoelectric; that is, it may have a first-order (linear) term in its elongation vs. voltage curve. The magnetic "poling" process has the same effect in this "push-pull" driver configuration. With no trapped flux in the reaction plate, there is no difference between $+I_d$ and $-I_d$ drive currents, and hence the $F_z(z)$ force must vary as $I_d^2$ (or higher even power terms). With the reaction plate "poled", the polarity of $I_p$ establishes a difference between $+I_d$ and $-I_d$ drive current directions, and hence the $F_z(z)$ force can have linear ($F_z(z) \propto I_d$) or higher odd-order terms (in addition to even-order terms). This can be most easily seen by writing the proportionality between the force, F, the drive coil current, $I_d$, and the "mirror" coil current, $I_m$, and then substituting in $I_m-I_d$ (Eq. 24) as $$F_z=kI_dI_m=kI_d(I_p-I_d)(\text{with poled current, } I_p) \qquad \text{Eq. 25}$$

Figure 7A:
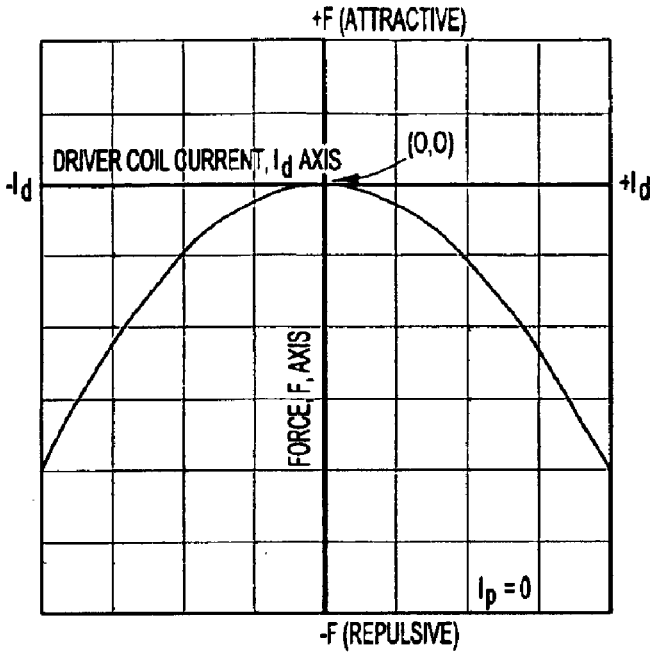
FIG. 7*a* is a graph of magnetic force versus magnetic driver tuning current for a "push" magnetic driver.
Figure 7B:
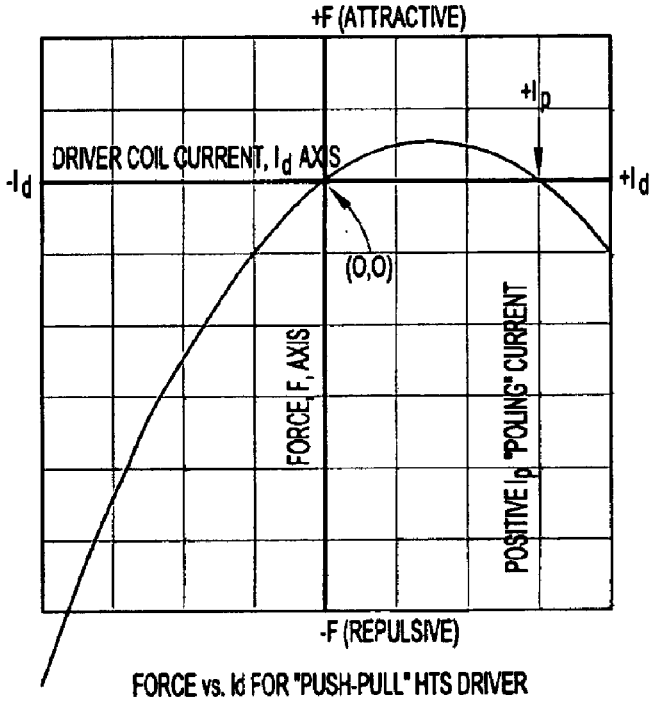
FIG. 7*b* is a graph of magnetic force versus magnetic driver tuning current for a "push-pull" magnetic driver.

Turning now to FIGS. 7*a* and 7*b*, a comparison of the generated magnetic force for a given current through the magnetic driver for both push and push-pull magnetic actuators can be made. The $F_z(I_d)$ curve for $I_p \overline{\gtrless} 0$ in FIG. 7*a* shows the usual "push", pure-repulsive $F_z$ proportional to $I_d^2$ force relationship (parabola centered at $I_d=0$). When the HTS reaction plate is "poled" with an equivalent "mirror" current, $I_p$, as in FIG. 7*b*, the parabola is shifted to $I_d=I_p/2$, with zero force points, $F_z=0$, at both $I_d=0$ and $I_d=I_p$, with attractive force between these points, $0<I_d<I_p$, and repulsive force outside of this region.

| | | |
|---|---|---|
| Repulsive force $I_d$ operation range: | $I_d < 0$ | Eq. 26 |
| Attractive force drive current range: | $0 < I_d < I_p$ | |
| Repulsive force "overdrive" $I_d$ range: | $I_d > I_p$ | |
| Normal "Push-Pull" Operation Range | $-I_p < I_d < I_p/2$ | |

There is indeed a first-order dependence of $F_z$ ($I_d$) near $I_d=0$ with substantial levels of attractive force available. In addition to achieving "push-pull" driver operation, "poling" the HTS reaction plate can substantially increase the driver current sensitivity. For example, in the illustration of FIG. 7*b*, in the $I_p=0$ driver curve, a driver current in either direction of 1 division gives a repulsive force of 0.25 divisions, whereas in the $I_p=+3$ divisions curve, a driver current of $I_d=-1$ division gives a repulsive force of 1 division, while an $I_d=+1$ division driver current gives an attractive force of 0.5 divisions. The more heavily the HTS reaction plate is poled (i.e., the greater the magnitude of $I_p$, the greater the current sensitivity, ($F_z/I_d$), and the greater the magnitude of attractive force which can be realized in the "push-pull" driver.

Of great practical interest is the issue of how best to accomplish the magnetic "poling" of the patterned HTS reaction plates in an array of tunable elements using these push-pull drivers. One method of poling the HTS reaction plate, would be to apply a drive coil current, $I_d=I_p$ while the HTS reaction plate is cooling down through its critical temperature (with the coil and plate in close proximity, of course). Applying a high level of drive current requires, of course, that the HTS drive coil be well below its critical superconducting temperature. On the other hand, at the start of the poling process, the HTS reaction plate must be above its critical temperature, $T_c$. This could, in principal be achieved by using, for example, TBCCO ("Thallium"), with $T_c$=92° K, for the coils, and "YBCO" with a $T_c$ about 10° K lower for the reaction plates. However, it is preferable that the coil temperature be as low as practical during the poling process to make the poled current, $I_p$, as high as possible. Also, it would be much more convenient to use the same HTS material for the entire device structure.

In an embodiment of the invention using the same HTS material in the magnetic driver and the reaction plate, it would be necessary to have a transient temperature difference between the HTS reaction plates and the HTS magnetic drivers during this poling process. Because the HTS planar coils of the magnetic drivers are on the fixed substrates which should have a good thermal path to the cryo-cooler head, while the HTS reaction plates (being on the movable substrate) have a relatively poor thermal path (relatively high thermal resistance) down to the fixed substrate, the present invention may exploit these thermal path differences. An extremely simple, exploitation of this would be to carry out the poling during the initial cooldown process; due to the better thermal path to the fixed substrate, the drive coils should become superconducting well before the HTS reaction plates on the movable substrates do. A more practical, but still very simple, approach would be to enclose a filament heater in a vacuum enclosure above the HTS substrate (with the movable substrate side facing the heater). After the both substrates are cooled down fully, the poling process would be initiated by briefly flooding the movable substrate with radiant energy from the heater. Because of the large thermal mass and high thermal conductivity path of the fixed substrate, the temperature rise in the HTS driver coils would be negligible. On the other hand, because of the low thermal mass and high thermal resistance of the movable substrates, they would quickly rise in temperature to above the $T_c$ of the HTS material, at which point the heater would be turned off. The poling of all of the "push-pull" driver reaction plates would be accomplished by applying the desired poling current, $I_p$ (usually using the largest coil current practicable) during the period when the movable substrates are cooling back down from their $T>T_c$ transient temperature to their original $T<<T_c$ temperature. An alternative to this "general radiant flood" approach for simultaneously poling all of the drivers on the substrate (and temporarily disabling the rf functionality of all of the tunable devices on the substrate) would be to selectively apply transient radiant heating pulses to individual devices from one or more directed source(s), such as lasers or light-emitting diodes. An additional theamal poling approach, which could be applied selectively, would be to apply current through a resistive element (heater) on each individual movable substrate. This could in fact be quite simple to implement. For example, a number of the mechanical designs of interest feature a rotational geometry, which would typically use a torsional suspension. If a thin carbon fiber, fine metallic wire, or metallized polymer membrane were used to implement this suspension, then simply passing a suitable level of current through this suspension wire could be used to heat the movable substrates above $T_c$. This same approach could be used with the vertical translational geometry illustrated in FIG. 1*a* by metallizing all or part of the suspension membrane.

In these transient temperature approaches to the magnetic poling of the HTS reaction plates, the time required for the poling operation will be determined by the transient cooldown time of the movable substrates in the environment where the fixed substrate and rest of the enclosure is fully cooled. Because of the small thermal mass of the thin movable substrates, this time should not be too long, but the poor thermal conduction path from the movable substrates to the fixed substrate and the reduced effectiveness of radiant heat transfer at cryogenic temperatures will make this cooldown longer in some cases. This would particularly be true if it proved necessary to re-pole the HTS reaction plates fairly frequently, as might be the case if the storage of very high flux levels were attempted.

In some applications where the time required to re-tune the HTS tunable filter elements is critical, achieving the maximum possible force levels out of the HTS drivers would be sought. In such cases, it would be desirable, for purposes of achieving maximum current sensitivity, $F_z/I_d$), and magnitude of attractive force, that the poling current, $I_p$, or flux, $\Phi_p$, level be as high as possible. At high flux levels in RTS materials it is possible for flux to slowly escape from superconducting loops ("flux creep"), which could necessitate re-poling the HTS reaction plates at some interval to maintain the value of $I_p$ at the desired level. While the somewhat limited levels of poled current, $I_p$, which it would be safe and practical to induce in the HTS reaction plates by passing a current, $I_d=I_p$ through the drive coils during the poling operation may not be sufficient to make flux leakage a significant problem, it would be preferable to be able to achieve much higher $I_p$, levels, and in that case fairly frequent "recharging" (re-poling) of the reaction plates might be needed.

A potential method for achieving very high flux levels in the HTS reaction plates for "push-pull" drivers, as well as the capability for very rapid re-poling, would be the application of a high-intensity pulsed magnetic field, $H_{zp}$, to the entire HTS structure, where H refers to the magnetic field applied in the perpendicular direction (z) to pole (p) the HTS reaction plates. If a more or less uniform external magnetic field, $H_{zp}$, is applied to the entire array of tunable HTS devices at a peak transient magnetic field intensity well above the critical field, IL, of the HTS superconductor material, then in effect the HTS loops in the "push-pull" HTS reaction plates will be momentarily be driven normal, with high levels of flux driven into the loops, even though they remain at a temperature well below $T_c$. As the transient external pulsed field dies out, however, the flux levels within the loops will very rapidly die out to a level sustainable given the $H_c$ of the HTS material. The stored flux, $\Phi_p$, or equivalent poling current, $I_p$, levels achievable using pulsed external field poling should be considerably greater than achievable by thermal transient poling through the drive coils. It should be noted that the use of a large external magnetic field, $H_{zp}>>H_c$, oriented in the axial (Z) direction would not necessarily end up with the same distribution of currents among the concentric loops in the HTS reaction plates as poling through the drive coils does. The empirical definition of the equivalent "minor" poling current, $I_p$, in this case would be by reference to the "push-pull" force expression, Eq. 24, in which $F_z(I_d)$ is parabolic, with the attractive force region bounded by zero force points at $I_d=0$ and $I_d=I_p$.

It is notable that the purpose of the "poling" process in the "push-pull" driver is to turn the HTS reaction plate into a type of permanent magnet. In an alternate embodiment of the invention, the HTS reaction plate may incorporate a permanent magnet material instead of captured circulating supercurrent. While this embodiment of the invention avoids the need for poling the HTS reaction plate, it introduces the complication of bringing a mixture of different technologies into play. In addition to the HTS materials technology, an efficient cryogenic temperature ferromagnetic material fabricationally compatible with the HTS material would be required. Another difficulty is that the magnetic poling pattern required for best performance with such a ferromagnetic reaction plate is rather complicated. To match the rectangular spiral planar coil configuration of FIG. 6, four wedge-shaped permanent magnet segments poled parallel to the surface and radially toward the center of the planar coil would be optimal.

The absolute force relationships for the all-HTS "push-pull" driver can be obtained by extension from the earlier pure-repulsive ("push") driver analysis. Note that with no current poled into the HTS reaction plate, the "push-pull" case of Eq. 25 reduces to the same $F_z=-k\ I_d^2$ relationship determined previously (e.g., Eqs. 13 and 18) for the "push" only drivers. Since the force constant, k, must be independent of $I_p$, comparing Eq. 25 with $I_p=0$, $[F_z=-k\ I_d^2]$, to Eqs. 13 or 18, $[F_z=A(\mu_o/2)I_d^2/P^2]$ gives $k=-A(\mu_o/2)/P^2$ for the constant (where the "−" sign is from our convention of a repulsive force being taken as positive). This gives for the "push-pull" driver force $$F_z/A=[-(\mu_o/2)P^2]I_d(I_d-I_p)(\text{For } z>P/2 \text{ and } D>>z) \quad \text{Eq. 27}$$

Figure 8:
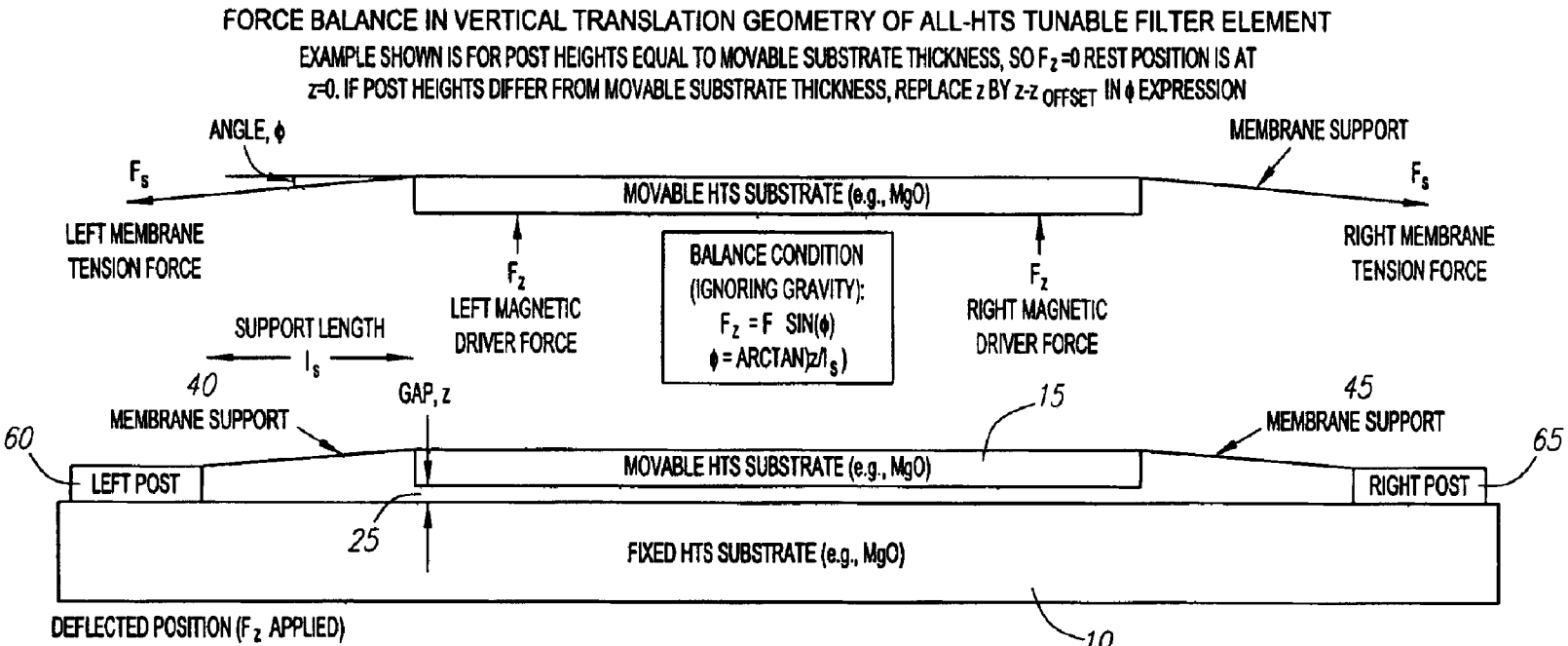
FIG. 8 is a cross-sectional view of the membrane-supported vertical translation geomety of a HTS tunable filter having a push magnetic actuator according to one embodiment of the invention.

Regardless of whether the magnetic actuator of the present invention is of the "push" or "push-pull" type, a mechanical means may be used to restore the movable substrate into position with respect to the fixed substrate after an adjustment by the magnetic actuator. As discussed with respect to the vertical translational configuration of FIGS. 1*a* and 1*c*, a restoring force may be provided by a first and a second membrane 40 and 45 attached to either end of the movable substrate 15. The mechanical aspects of this design are further illustrated in FIG. 8 wherein the heights of the two membrane support posts 60 and 65 are equal to the thickness of the movable substrate 15 (i.e., $z_{offset}=0$ where $z_{offset}$ denotes the rest gap length between the fixed and movable substrates when no tuning current flows through the magnetic actuators ($F_z=0$)). Should the post heights, $t_{post}$ be greater than the thickness of the movable substrate, $t_{msub}$, then the rest position of the substrate with no magnetic driver force, $F_z$, applied (ignoring the gravitational force on the moving-substrate) will be at a gap $$z=z_{offset}=t_{post}-t_{msub}(\text{rest position for } F_z=0 \text{ for } z_{offset}\geqq 0) \quad \text{Eq. 28}$$

In embodiments of the invention in which the posts are shorter than the movable substrate, $z_{offset}$ is negative and the actual rest position will be at z=0 due to contact between the movable substrate and the fixed substrate, but as long as $F_z$ is such that $z\geqq 0$, the "spring" force expressions are all valid for negative values of $z_{offset}$. (In fact, if pure repulsive drivers were used, particularly with feedback positional control then negative $z_{offset}$ values would typically be utilized to insure the availability of adequate restoring force at small values of z to allow for fast response.) The principal "spring" restoring force in this embodiment comes from the initial tension, $T_m$, in the membrane (where $T_m$ is the force per unit width in the direction between the movable substrate and posts in units of newtons per meter). For a width, $W_m$, of the membrane, the tensile force in the membrane support, $F_s$, will be given by $$F_s=W_mT_m(\text{newtons}) \quad \text{Eq. 29}$$

At a substrate position (gap), z, the angle, ϕ, of the membrane support will be given from z and the length of the membrane between post and movable substrate, $l_s$, by $$\phi=\text{ArcTan}[(z-z_{offset})/l_s](\text{membrane angle}) \quad \text{Eq. 30}$$

This places a downward force on the movable substrate, $F_s$ Sin(ϕ), that opposes the upward (repulsive) force from the magnetic driver, $F_z$. The balance condition between these two forces will be $$F_zF_s\ \text{Sin}(\phi)=F_s\ \text{Sin}\{[\text{ArcTan}[(z-z_{offset})/1_s)]\}\approx F_s[(z-z_{offset})/l_s \quad \text{Eq. 31}$$

The latter approximation is valid for small angles, +, where Sin(ϕ)=Tan(ϕ)=ϕ, in which range the membrane tension, $T_m$, and force, $F_s$, are virtually independent of z. The steady-state movable substrate deflection, $z-z_{offset}$, achievable with a drive force, $F_z$, will be given by $$(z-z_{offset})=(l_s/F_s)F_2(\text{steady-state deflection}) \quad \text{Eq. 32}$$

The open-loop dynamics of this type of translational movable substrate depend on the type of magnetic driver used. If a multi-pole driver of the type shown in FIGS. 4 and 5, which itself has a steep $F_z(z)$ curve, the effective spring constant for oscillation will be dominated, at least for strong drive currents, $I_d$, by the $F_z$ (z) of the driver. For single-pole magnetic drivers, however, the $F_z$ (z) curves, as illustrated in FIG. 3, tend to be quite flat ($F_z\approx$independent of z) over most of the range of interest. In that case, the effective spring constant, $K_2$, operating on half of the mass of the moving substrate, $M_{ms}/2$, (half, because of the choice in FIG. 8 and Eqs. 28 to 30 to treat the driver and suspension forces on one side [e.g., left side driver and membrane forces] only) will be given by $$K_z=dF/dz=F_s/l_s(\text{for compliant driver } F_z(z)) \quad \text{Eq. 33}$$

The open-loop mechanical oscillation frequency, $F_{osc}$, for the $M_{ms}/2$ mass with this support spring constant, $K_2$, will be given by $$F_{osc}=(1/2\pi)Sqrt[K_z/2)](M_{ms}/2)]=(1/2\pi)Sqrt(2F_s/1_sM_{ms}) \quad \text{Eq. 34}$$

The quantity $F_s/l_s$ is a design parameter of the support membrane set principally, from Eq. 31, by the desired maximum deflection range, $\Delta z_{max}$ and maximum available driver force, $(F_z)_{max}$ by $F_s/l_s=((F_z/\Delta z_{max}$, so that Eq. 34 may also be written as $$F_{osc}=(1/2\pi)Sqrt[2(F_z)_{max}/\Delta z_{max}M_{ms})] \quad \text{Eq. 35}$$

Using the $(F_z)_{max}$ values from Table 1, and assuming a $\Delta z_{max}=10\ \mu m$ deflection range is desired gives, for the "conservative" design rules an open-loop mechanical resonant frequency of $F_{osc}=416$ Hz, while for the "more aggressive" design rules, a higher, $F_{osc}=4.44$ kHz, resonant frequency would be realized.

It is possible to operate a device of this membrane suspended vertical translational geometry with "push" magnetic drivers in an open-loop mode, in which the tuning is selected by simply forcing a given drive current, $I_d$, through the drive coils, generating a magnetic drive force, $F_{mz}(I_d,z)$, and waiting for the motion of the movable substrate to bring the sum of the gravitational and spring restoring forces into balance with $F_m(I_d,z)$. Unfortunately, the settling time after $I_d$ tuning changes in such open-loop operation can be quite substantial, particularly if the mechanical Q of the translational oscillation of the movable substrate is high (which is equivalent to saying its mechanical damping factor is low). To achieve a final tuning precision corresponding to a small fraction of the tuning change, the settling time required is much greater than the product of the mechanical Q times the period of mechanical oscillation (or $T_{setting}>>Q_m/F_{osc}$).

Open-loop operation is also very susceptible to tuning frequency shifts induced by changes in gravitational orientation or external acceleration (vibration or "microphonic") effects. Hence, open-loop tuning would not be optimal for applications in which very rapid tuning, and freedom from detuning in the presence of gravitational or other acceleration changes is desirable during operation. In closed-loop operation, with high loop gain, it is possible to approach pure acceleration-limited positional transition times, T, (rest-to-rest) as given for equal maximum +z and −z accelerations, $a_{z+}=a_{z-}=a_z$ for a displacement distance, Δz, as $$T=Sqrt(4\Delta z/a_z)(\text{acceleration limited}) \quad \text{Eq. 36}$$

Table 1 includes typical values for T for the driver embodiments discussed therein. Note that with a "push-pull" driver, the mechanical design strategies for best performance in feedback operation is to use the most compliant practical suspension (lowest value of $F_s/l_s$), which will give a very low natural frequency, $F_{osc}$, but also the lowest level of "wasted" forces driving the suspension "spring". The closed-loop operating frequencies will be far beyond $F_{osc}$, dictated principally by the acceleration-limited time, T. In the case of a pure-repulsive driver, the −z force must be provided by the suspension. If equal positive and negative accelerations were to be achieved, half of the maximum repulsive driver force would be used to offset the suspension spring force, so the available acceleration in Eq. 35 would be reduced by a factor of two. Again, however, it is desirable to have maximum spring compliance (for minimum change in this spring force over the travel range), so that typically a negative value of $z_{offset}$ would be used for this type of closed-loop operation with "push" only (repulsion) drivers.

Figure 9:
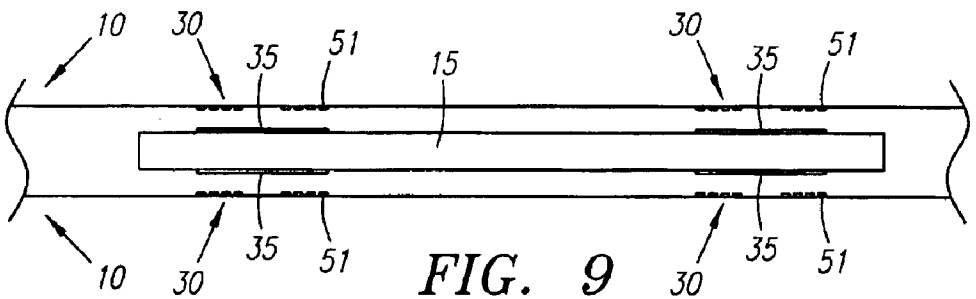
FIG. 9 is a cross-sectional view of a pair of push magnetic actuators mounted on either side of the movable substrate to effect a "push-pull" operation.

In an alternate embodiment, a "push-pull" operation may be achieved with the translational geometry just discussed by placing repulsive drivers, i.e., mounting HTS drive coils, above and below the HTS reaction plates on the movable substrate. FIG. 9 illustrates this geometry. The movable substrate 15 lies between opposing surfaces of the fixed substrate 10. HTS reaction plates 35 are deposited on both the lower and upper surface of the movable substrate. Note that if the range of the $F_m(I_d,z)$ magnetic driver force extends well beyond the thickness of the movable substrate (as for single-pole driver coils), with the proper positioning of the drivers, only one HTS reaction plate is required. Opposing each of these reaction plates 35 are the magnetic drivers 30 each having a continuous strip 51 of HFTS material forming a planar spiral coil. In this way, applying a current through the coils on the fixed substrate plane below the movable substrate 15 would produce a force in the +z direction, while activating the coils mounted on the fixed substrate plane above the movable substrate 15 would produce a −z force.

Figure 10A:
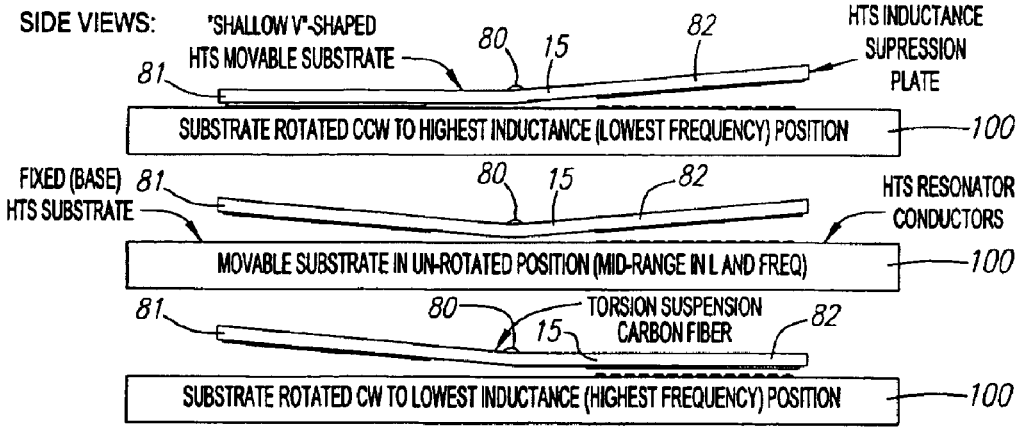
FIG. 10*a* is a cross-sectional view of a tunable filter having a torsionally-suspended movable substrate with a dihedral configuration, in three rotational tuning positions, wherein repulsive "push" magnetic drivers are located on opposing sides of a rotational axis of the movable substrate, thereby providing a "push-pull" operation.
Figure 10B:
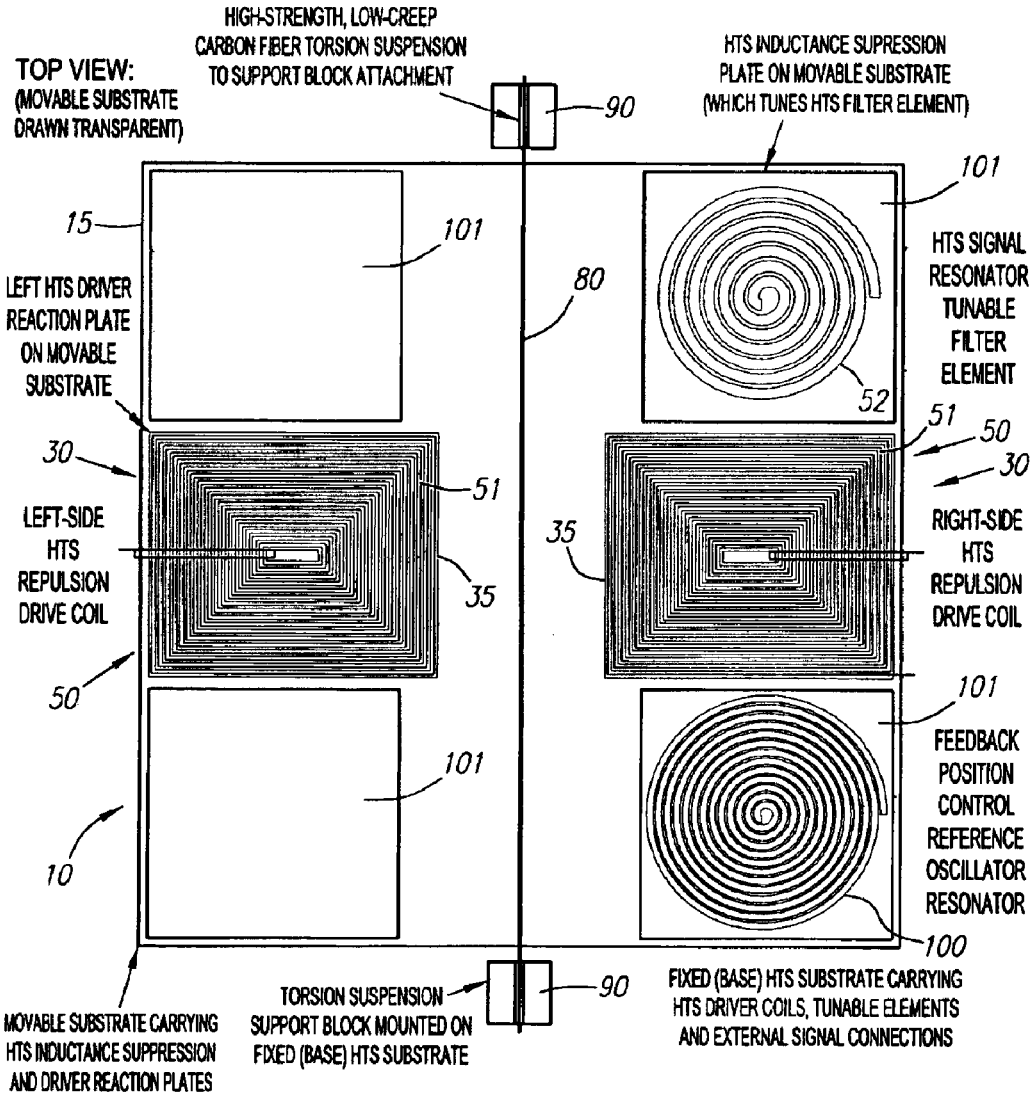
FIG. 10*b* is a plan view of the tunable filter of FIG. 10*a*.
Figure 10C:
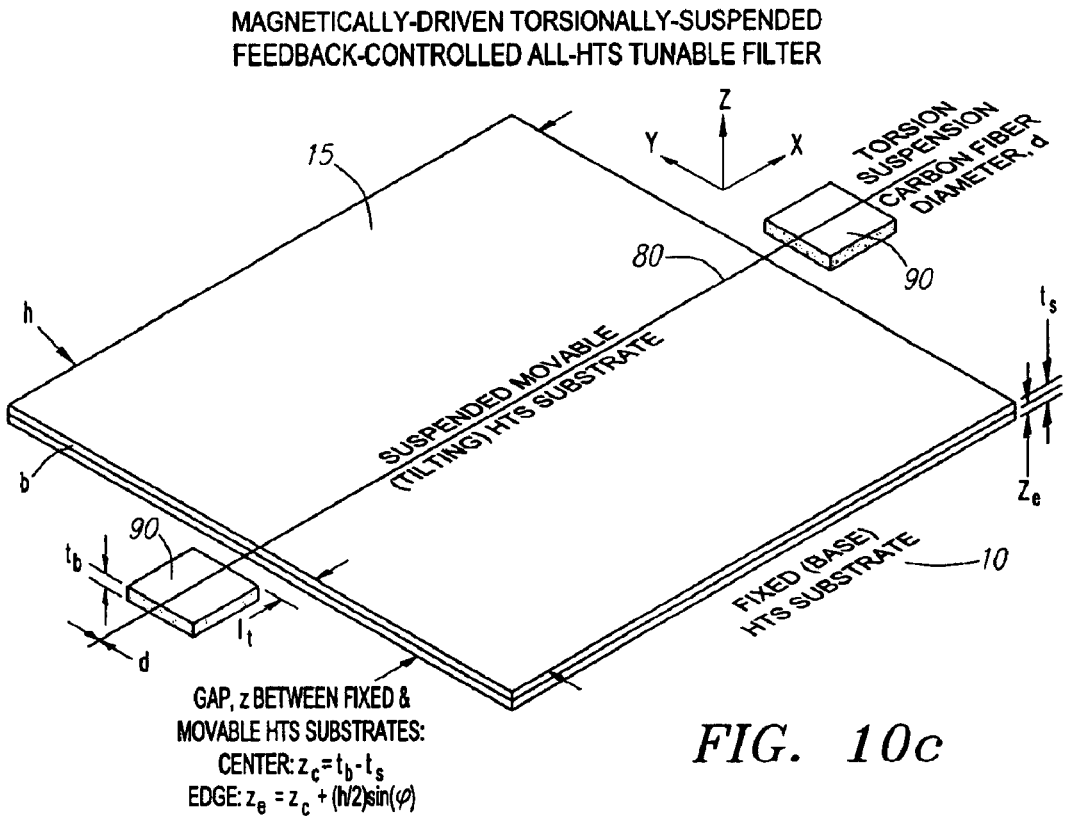
FIG. 10*c* is an isometric view of a tunable filter similar to that of FIG. 10*b*, the difference being that the movable substrate of FIG. 10*c* comprises a single planar element.

In a preferred embodiment of the invention, a mechanical push-pull structure can be realizedi with all of the drive coils fabricated on the same surface of the fixed substrate by using a rotational design such as illustrated in FIGS. 10*a*, 10*b* and 10*c*. In this embodiment, the movable substrate 15 is suspended on a torsion fiber 80. The movable substrate may be planar as illustrated in FIG. 10*c*, or for a much wider tuning range, the movable substrate may have a dihedral configuration wherein a first planar portion 81 and a second planar portion 82 form the dihedral as illustrated in FIG. 10*a*. The torsion fiber 80 attaches to suspension posts 90 (illustrated in FIGS. 10*b* and 10*c*) of equal thickness $t_b$ positioned on the fixed substrate 10 such that the movable substrate 15 is suspended between the suspension posts 90. Preferably, the torsion fiber 80 is positioned on a centerline of the upper surface of the movable substrate 15 such that, absent additional forces, the lower surface of the suspended movable substrate 15 is parallel, in the case of a planar substrate, or at equal angles (un-rotated position in FIG. 10*a*), in the case of a movable substrate having a dihedral configuration, to the upper surface of the fixed substrate 10. One or more magnetic actuators 30 (illustrated in FIG. 10*b*) are located on either side of the torsion fiber 80. As discussed with respect to FIGS. 1*a*–1*c*, each magnetic actuator 30 comprises an HTS reaction plate 35 on the lower surface of the movable substrate 15 (the reaction plates 35 and the movable substrate 15 are drawn transparent in FIG. 10*b*) that substantially overlaps a magnetic driver 50 on the upper surface of the fixed substrate 10, wherein the magnetic driver 50 includes a continuous strip 51 of HTS material that is preferably formed into a rectangular "spiral" coil. As shown in FIG. 10*b*, the magnetic actuators 30 may be denoted as being on the left or the right side of the torsion fiber 80. The movable substrate 15 thus behaves like a "teeter-totter", rotating to the right when the left-hand repulsive drive coil(s) are activated, and to the left when drive current is applied to the right-hand drive coil(s).

To keep the rotational restoring forces and natural rotational oscillation frequency low for optimal closed-loop operation, the diameter, d, of the torsion fiber 80 is kept small. If the lengths of the unsupported torsion fiber segments between the suspension posts 90 and the movable substrate 15 is $l_t$, and the shear modulus of the fiber material is $G_s$, the combined torsional (rotational) spring constant, $k_\phi$, including both ends of the torsion fiber 80, for a circular fiber diameter, d, with cross sectional area moment of inertia, $J=(\pi/32)d^4$, will be given by $$k_\phi=2JG_s/l_t=(\pi/16)d^4G_s/l_t \quad \text{Eq. 37}$$

To achieve a high degree of rotational compliance (very low $k_\phi$), the torsion fiber diameter d is kept as small as possible (because of the $d^4$ term in Eq. 32), and its shear modulus is kept as low as possible. While increasing the unsupported fiber (gap) lengths, $l_t$, between the support posts and the movable substrate would also reduce $k_\phi$, this would be at the expense of making the movable substrate susceptible to undesired vertical translational mechanical oscillations. Since it is preferable to utilize feedback control of the rotational position, φ, of the movable substrate in order to increase tuning speed and maintain precise tuning in the presence of external accelerations, vibration, etc., high feedback gain is required. The use of high feedback gain is possible as long as the motion of the movable substrate is essentially purely rotational, as a rigid body. The presence of either rigid body vibrational modes (such as the vertical translational motion noted above) due to the translational "springiness" of the suspension fiber, or flexural vibrational modes of the movable substrate itself, or combinations of these, limits the usable feedback gain before parasitic oscillations of the feedback control system will result. The higher in mechanical resonant frequency these parasitic translational or flexural vibrations can be pushed by increasing the "stiffness" of the system to these modes, the higher is the feedback gain that can be used in the control system, and hence the better the tuning performance that can be realized. As noted in Eq. 34, if the tensile force in the torsion fiber is $F_s$, and the mass of the movable substrate is $M_{ms}$ ($M_{ms}=\rho_s t_s bh$, where $\rho_s$ is the movable substrate density, $t_s$ its thickness, b its length and h its width, as shown in FIG. 10*c*), the rigid-body translational resonant frequency, $F_{osc}$, of the suspended substrate is given by $F_{osc}=(1/2\pi)Sqrt(2F_s/l_tM_{ms})$. This shows that the desired increase in translational resonant frequency is accomplished by minimizing substrate mass, $M_{ms}$, and gap length, $l_t$, but principally by increasing the tensile force, $F_s$, in the suspension fiber. Note from Eq. 37 that while reducing $l_t$, which raises $F_{osc}$, also raises the rotational spring constant, $k_\phi$ (which is undesired), increasing the tensile force, $F_s$, in the suspension fiber to raise $F_{osc}$ has no adverse effect on $k_\phi$. This suggests that in order to maxinize the parasitic translational vibrational frequency, $F_{osc}$, while maintaining a very low rotational spring constant, $k_\phi$, the use of a suspension fiber material having stiff, strong tensile properties (high tensile or longitudinal modulus and tensile strength) but a low shear modulus would be ideal. In that regard, carbon fiber material appears ideal, since it has a longitudinal modulus to shear modulus ratio of 359 Gpa/14.4 Gpa=25 (as compared to steel with a ratio of 205 Gpa/84 Gpa=2.44).

The rotational resonant frequency of the movable substrate in FIGS. 10*a–c* is determined from the rotational (torsional) spring constant, $k_\phi$, from Eq. 37, by $$F_r=(1/2\pi)Sqrt(k_\phi/I_{xx})\text{(Rotational Resonant Frequency)} \quad \text{Eq. 38}$$

where $I_{xx}$ is the movable substrate mass moment of inertia, given for a thin rectangular plate with rotational axis through its centroid as in FIG. 10*c* by $$I_{xx}=\rho_s t_s bh^3/12\text{(Mass Moment of Inertia)} \quad \text{Eq. 39}$$

While Eq. 39 is derived for a flat plate as in FIG. 10*c*, it will closely approximate $I_{xx}$ for a dihedral ("V"-shaped cross section) movable substrate as in FIG. 10*a*, as long as the dihedral angle is low ("V" very shallow).

The tuning speed in this torsionally-suspended feedback-controlled all-HTS tunable filter configuration of FIGS. 10*a*, 10*b*, 10*c* is also determined by this mass moment of inertia, $I_{xx}$, from Eq.39, and the applied torque from the HTS magnetic actuators. The equation of motion for pure rotation of the movable substrate with an applied actuator torque, $T_s$, is $$I_{xx}(d^2\phi/dt^2)=T_z-k_\phi\phi\text{(Equation of Motion)} \quad \text{Eq. 40}$$

where $\phi$ is measured from the position where there is no torque from the torsion fiber (this is normally the rest position with no applied torque, unless the torsion fiber is installed tisted", such that one of the edges of the movable substrate contacts the fixed substrate in the rest position). Solving Eq. 40 with Ta=0 gives the rotational resonant frequency of Eq. 38. The steady-state movable substrate position (rotational angle) is given by setting $d^2\phi/dt^2=d\phi/dt=0$, giving $$\phi=T_s/k_\phi\text{(Steady-State Rotational Angle)} \quad \text{Eq. 41}$$

From the standpoint of tuning stability (ultra-low $\Delta F_o$ in Eq. 4, or minimum phase noise contamination of filtered signals), it is best that the applied torque, $T_s$ in Eq. 41, be as small as possible, which is achieved by having $k_\phi$ very small. This "inertial stabilization" mode of operation makes $I_{xx}(d^2\phi/dt^2)$ the dominant torque term in the equation of motion (Eq. 40), and this term tends to reduce the variations of $\phi$ or $\Delta F_o$ to zero. On the other hand, if this $I_{xx}(d^2\phi/dt^2)$ inertial term were zero, any noise or fluctuations in the drive current, $I_d$, would appear as fluctuations of $T_s$, and hence would immediately translate into fluctuations of $\phi$ or $\Delta F_o$ tuning variations, that will induce phase noise on the filtered signals (Eq. 4). Hence this "inertial stabilization" mode of operation is a way of achieving very low phase noise without placing unrealistic requirements on the purity of the supply for the tuning current, $I_d$. (In conventional varactor-tuned systems, which have no $I_{xx}(d^2\phi/dt^2)$ inertial term to help them, implementing sufficiently pure/stable tuning supplies is always a problem, and, as indicated in Eq. 4, this problem would be much worse with HTS because of the much higher $Q_o$ values attainable in HTS resonators.)

The effectiveness of this "inertial stabilization" mode of operation achieved by having $k_\phi$ very small is enhanced by the square-law, $T_m \propto I_d^2$, nature of the repulsive ("push") HTS drivers. Consider the case of symmetrically disposed single pole drive coils, as illustrated in FIGS. 10*b* and 10*c*, each having an area, $A_d$ (where $A_d \approx bh/9$ is illustrated) and located with their centers at a radial distance, $R_d$, from the rotational axis (where $R_d \approx h/3$). The torque, T, produced by passing a drive current, $I_d$, through one of these drive coils will be given from the magnetic pressure, $F_m/A$, from Eq. 13 or 18, given a coil conductor pitch, P, by $$T_m=\pm F_m R_d=\pm(\mu_o/2)R_d A_d I_d^2/P^2\text{(Magnetic Driver Torque)} \quad \text{Eq. 42}$$

where the sign of the torque depends on which of the two opposing drivers is excited with the current, $I_d$. This square-law behavior means that the fluctuations in torque, $\Delta T_m$, produced by fluctuations in drive current, $\Delta I_d$, will be given (in terms of the constant, $C_{ti}=(\mu_o/2)\ R_d A_d/P^2$, from $T_m=\pm C_{ti} I_d^2$) by $$\Delta T_m/\Delta I_d=2\ C_{ti} I_d=2\ Sqrt(T_m/C_{ti})=2\ Sqrt(k_\phi\phi/C_{ti}) \quad \text{Eq. 43}$$

Eq. 43 shows that if the rotational spring constant, $k_{100}$, is made very small, then (from Eq. 41) the steady-state torque, $T_m$, will be small, and the torque fluctuations induced by fluctuations in $I_d$ will be very small because $\Delta T_m/\Delta I_d$ falls off as $T_m^{0.5}$. This also illustrates the advantage of having the movable substrate well balanced for operation with the rotational axis in the horizontal position, as illustrated in FIGS. 10*a* through 10*c*, since any static imbalance torque would have to be offset by a magnetic driver torque, $T_m$, which would increase $\Delta T_m/\Delta I_d$.

With a small value of the rotational spring constant, $k_\phi$, or correspondingly, a low value of the rotational resonant frequency, $F_r$, (from Eq. 38), the tuning dynamics, with proper feedback (or feed-forward/feedback) control system design, will be dominated by the inertia, with the $k_\phi\phi$ term negligible, so that Eq. 40 simply becomes $I_{xx}\ (d^2/dt^2)\cong T_a$. Ignoring $k_\phi$, rest-to-rest rotation of the movable substrate by an angle, $\Delta\phi$, can be accomplished fastest (for a given maximum driver torque, $T_m$, by applying a torque of $+T_m$ for a period of $\Delta t_t/2$, followed by a torque of $-T_m$ for an equal period of $\Delta t_t/2$. In this case, the total rest-to-rest tuning time, $\Delta t$, will be given by $$\Delta t_t=2Sqrt(I_{xx}\Delta\phi/T_m)\text{(Rest-to-Rest Tuning Time)} \quad \text{Eq. 44}$$

For a given tuning angle, $\Delta\phi$, the tuning time, $\Delta t_t$, can be reduced by either increasing the torque, $T_m$, which as noted in conjunction with Eqs. 8 and 9 and Table I, is ultimately limited by the $J_{max}$ and thickness, $t_m$, of the superconducting films, or by reducing $I_{xx}$. Assuming that the length, b, and width, h, of the movable substrate are set by the requirements of the HTS resonator or other tunable filter elements being implemented in the HTS tunable filter circuit, $I_{xx}$ can only be reduced by choosing a material with low density, $\rho_s$, for the movable substrate, or making its thickness, $t_s$, very small. There is a limit, however, to how thin the movable substrate can be made before it becomes subject to flexural vibration problems that would tend to destabilize the positional feedback control system, limiting the amount of feedback gain that could be used without danger of oscillation. A measure of the potential severity of this problem can be attained by considering the vibrational modes of a thin free square plate of sides b=h=a, and thickness, $t_s$, made of a material having density, density, $\rho_s$, and elastic modulus, $E_e$ (e.g., for MgO, $\rho_s$=3.5837 g/cm$^3$ and $E_c$=250 GPa). The flexural rigidity, $D_f$, of the plate will be, assuming a Poisson's ratio of about v=0.26 for the material, $$D_f=E_e t_s^3/12(1-v^2)\approx E_e t_s^3/11.19 \text{(Flexural Rigidity)} \quad \text{Eq. 45}$$

The free-plate vibrational resonant frequencies, $F_{bi}$ (see, for example, Mark's Standard Handbook for Mechanical Engineers, Eighth Edition, pp. 5–74 and 5–75), for the i=1, 2 and 3 flexural (bending) modes are given by $$F_{bi}=[\alpha_i/(2\pi a^2)]Sqrt(D_f/\rho_s t_s) \text{(Flexural Resonances)} \quad \text{Eq. 46}$$

where $\alpha_1$=14.10, $\alpha_2$=20.56, and $\alpha_3$=23.91. Letting b=h=a=1.5 cm MgO substrate, $t_s$=50 $\mu$m thick, in the example of FIG. 10*c*, the first three flexural vibration (bending mode) frequencies (Eq. 46) are at $F_{bi}$=1.25 kHz, 1.82 kHz, and 2.11 kHz, in comparison to the desired rotational (torsional) resonant frequency (Eq. 38) of Fr=3.078 Hz, and the parasitic (rigid body translational) vibration (Eq. 34) at $F_{osc}$=958 Hz.

While there is outstanding frequency separation between the desired rotational mode ($F_r$=3.078 Hz) and the undesired suspension translational vibration mode ($F_{osc}$=958 Hz, or probably slightly less due to substrate bending), and the substrate bending modes (1:25 kHz, etc.) are also well separated from 3.078 Hz, it is desirable to tune the device at as high a rate as possible (Eq. 44), consistent with the magnetic pressure achievable in the actuators. Applying short (e.g., few milliseconds or less), maximum-force tuning pulses to accelerate and stop the armature rotation in minimum time has the potential to excite significant vibrational energy in undesired translational or flexural vibrational modes of the armature. For example, ideally, the rapid tuning torque would-be applied as a pure laterally-displaced opposing-force couple (i.e., attractive force applied on one driver and an equal repulsive force applied to the driver on the opposite side of the rotational axis). The application of such a pure equal but opposite force couple would impart no net vertical translational force to the armature, and hence would, assuming a rigid armature, result in only pure rotational motion, with no translational component.

In actual practice, however, because of the greater difficulty of fabricating "push-pull" drivers, generally this torsionally-suspended all-HTS tunable filter would be implemented using "push-only" repulsive HTS actuators. The effect of "push-pull" operation is achieved by activating only one of the opposing repulsive drivers at a time, with their location on the opposing sides of the rotational axis giving the two opposing torque directions. The force couple producing the torque is comprised of the upward (repulsive) magnetic pressure produced by whichever actuator coil is activated, balanced by the downward vertical translational restoring force produced by the torsion suspension fiber resisting its upward motion of the rotational axis. Hence, in such operation, the repulsive magnetic pressure from the drivers will in general result in a combination of the desired armature rotation plus some measure of undesired vertical translational (vibrational) motion. The magnitude of the vibrational motion depends on both the translational spring constant, K, (Eq. 33), and translational resonant frequency, $F_{osc}$ (Eq.34), and details of the applied driver current pulse shape (e.g., risetime, pulsewidth, etc.).

One way to increase $K_z$ to minimize the excitation of vertical translational vibrations would be (Eq. 31) to increase the tension force, $F_s$, in the suspension fiber, or to reduce the gap, It, between the suspension post and armature (this gap, $l_t$, is denoted ls in Eq. 31). Reducing $l_t$ would directly increase the rotational spring constant, $k_\phi$ (Eq 37), as would increasing $F_s$ if this necessitated increasing the fiber diameter, d. In this way, both the rotational and translational resonant frequencies, $F_r$ and $F_{osc}$, can be increased, which will tend to result, on average, in less translational motion being excited through the application of "push" tuning force pulses of a given width and amplitude. However, increasing $k_\phi$ has the undesirable effect of increasing the static tuning currents required to maintain a given rotational angle, $\phi$, and to make the tuning more sensitive to small variations in drive current, $I_d$. Another, more sophisticated, approach to minimizing the vertical translational vibrations induced by the application of short, high-amplitude $I_d$ current pulses to the magnetic actuator drive coils is to optimize the shape and/or pulsewidth of the $I_d(t)$ drive current pulses used to rapidly rotate and stop the armature. If the magnitude of the Fourier transform of the $F_z(t)$ (where $F_z(t)$ is generally proportional to $[I_d(t)]^2$) magnetic driver pulse waveform, Mag[Fz(f)], is made to be zero at the armature vertical translational resonant frequency, $F_{osc}$, then virtually no energy will be coupled into translational vibrations. For example, one simple way to do this is to use constant-amplitude drive current pulses, but to make the duration of the drive current pulses an exact integer multiple of the translational oscillation period, $T_{osc}=1/F_{osc}$. (This has the effect of placing one of the nodes [zero crossings] of the well-known sin(x)/x Fourier transform of a rectangular pulse at $F_{osc}$.) With a discrete set of $I_d(t)$ pulsewidths to work with, continuous selection of the magnitude, $\Delta\phi$, of the rapid tuning position change could be made by altering the magnitude of the accelerating and decelerating current pulses, or by introducing a variable amount of time spacing between fixed-amplitude accelerating and decelerating current pulses (i.e., variable "coasting" time at maximum angular velocity before tuning rotation of the armature is stopped).

Note that while the excitation of the parasitic vertical translational (rigid body vibrational) mode can be suppressed in rapid tuning operations by careful optimization of magnetic actuator current drive waveforms, the many possible flexural modes makes it impractical to handle all of these with pulsewidth optimization. It is advantageous to optimally locate the center of magnetic pressure from the HTS actuator drive coils over vibrational nodes of the lowest frequency flexural vibration modes of the movable substrate (armature), but that is practical for only a small number of the lowest frequency flexural modes. Beyond that, it may be necessary to make the substrate sufficiently thick (or add stiffeners or "mode spoilers") to ensure that the resonant frequencies of these flexural modes are high enough to not cause a problem in fast tuning or reduce the amount of feedback gain useable in closed-loop feedback control without instability problems. The calculated free-plate resonances at 1.25 KHz, 1.82 KHz, 2.11 KHz, etc., are only just barely as low as necessary for compatibility with high gain, so further tinning of this sized substrate beyond $t_s$=50 $\mu$m to speed tuning (Eq. 44) would probably be counterproductive with this movable substrate size (b=h=a=1.5 cm). In fact, with careful placement of the magnetic drivers at vibrational nodes, excitation of one or two of the lowest frequency ("softest") flexural modes might be minimized. Further, a dihedral (shallow "V"-shaped) movable substrate will resist bending along the axis of the suspension fiber, which will discourage combined translation and bending that could otherwise lower the $F_{osc}$=958 Hz vertical translational resonant frequency and increase tuning shift due to gravitational "sagging" of the torsional suspension fiber as the gravitational orientation is changed (or external accelerations are applied). It may also be possible to add stiffening members to the movable substrate to increase the flexural rigidity to increase the $F_{bi}$ bending resonances without unduly increasing the mass and $I_{xx}$.

As illustrated in FIG. 10*b*, the rotational tuning provided by placing a magnetic actuator 30 on either side of a torsion fiber 80 supporting the movable substrate 15 may be used to tune the frequency responses of a spiral HTS resonator 102. As the movable substrate 15 rotates with respect to the fixed substrate 10, an HTS inductance suppression plate 101 is brought closer or farther with respect to the resonator 102, affecting its frequency response. The resonator 102 is of a distributed coplanar spiral resonator type in which coplanar transmission line distributed capacitance and inductance, as well as turn-to-turn mutual inductances, can play a role, in varying its frequency responses. Other variable elements such as the split electrode capacitor structure shown in FIG. 1*b* could be used in place of the resonator 101 (typically in conjunction with a fixed HTS inductor to form a resonator), or a variable inductor of the type described herein with respect to FIGS. 11*a* and 11*b* could be used (again, typically in conjunction with a fixed capacitor to form a resonator, in order to facilitate frequency readout of position by inclusion in a reference oscillator circuit).

As shown in FIG. 10*b*, a reference resonator 100 may be used in a closed loop positional feedback network to control the amount of tuning current applied through drive coils of the magnetic actuators 30. The reference resonator 100 would typically be included as part of a reference oscillator, such that the tuning position of the movable substrate 15 can be very accurately read out through the reference oscillator frequency. Because of the very rapid change of phase vs. frequency in a very high Q HTS resonator (Eqs. 3 and 4), the frequency of the reference oscillator (assuming the very high Q is not spoiled by oscillator loading or overcoupling) will be an extremely stable reflection of the resonant frequency of the signal resonator. While the $F_{res}(z)$ resonant frequency vs. gap curves for the signal resonator and reference oscillator could differ substantially both in scale (which would generally be the case so as to not operate the reference oscillator near the signal frequency to avoid signal contamination) and in the $F_{res}(z)$ functional shape, there would always be a 1:1 correspondence which could be stored in a frequency control lookup table by which the correct reference oscillator frequency needed for the feedback control system to give exactly the desired signal resonator frequency can be determined.

Figure 11A:
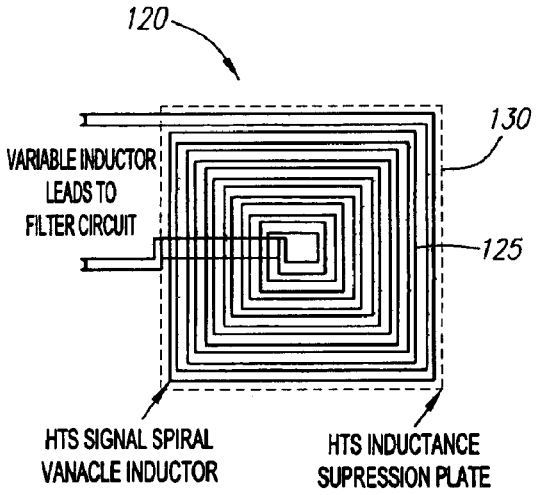
FIG. 11*a* is plan view of a spiral inductor.
Figure 11B:
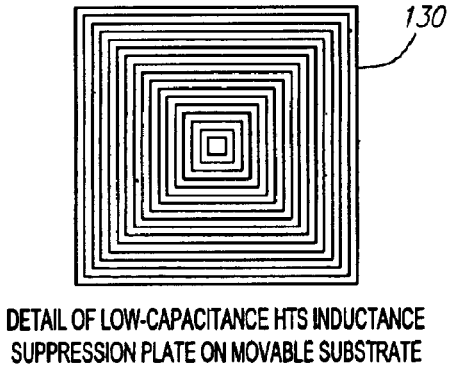
FIG. 11*b* is a plan view of a low-capacitance HTS inductance suppression plate.

Turning now to FIGS. 11*a*–11*b*, a variable inductor 120 whose electrical properties may be varied by the magnetic actuator of the present invention is illustrated. The variable inductor 120 comprises a spiral HTS inductor 125 formed on the upper surface of a fixed substrate. An HTS inductance suppression plate 130 on the lower surface of a movable substrate substantially overlaps the spiral HTS inductor 125. To reduce parasitic capacitive effects, the HTS inductance suppression plate 130 preferably comprises a plurality of concentric loops of HTS material arranged at a pitch that substantially matches the pitch of the spiral HTS inductor 125. It is to be noted that this embodiment of a variable inductor may replace the variable capacitor used in other embodiments of the invention discussed herein.

As revealed by the following discussion, the inductance of a variable inductor has a linear relationship with respect to the gap distance between the movable and fixed substrates (up to a gap of 1 mm depending upon the coil diameter within the variable inductor.) The magnetic energy, $E_m$, stored in an inductor of inductance, L(z), carrying current, L is given by $$E_m=(1/2)L(z)I^2 \text{(Energy Stored in Inductor)} \qquad \text{Eq. 47}$$

Note that in terms of fields (Eq. 7), $E_m/A=(1/2\mu_o)\,B^2\,z$ From Eq. 12, B is proportional to L which suggests that the inductance L(z) should be proportional to z (at least for narrow gaps, z). In fact, in analogy with the reason (FIG. 2) the force versus distance of a single-pole magnetic drive coil tends to be nearly constant out to gaps, z, approaching the radius of the coil, the inductance of a spiral inductor should tend to increase linearly from an inductance of L=0 at z=0 up to an inductance approaching the "free space" (no inductance suppressor plate) inductance as the gap, z, becomes comparable with the outer radius of the spiral. This general energy-based argument was checked by a careful analysis of a 1 mm outer radius 6-loop planar spiral inductor with 0.05 mm loop pitch, including all of the self inductances of the 6-loops in the spiral (the $L_{ii}$ terms) and the mutual inductances from each loop to all of the other loops in the spiral (the $+2M_{ij}$ terms), minus the mutual inductances to all of the "mirror" loops on the other side of the HTS suppressor plate plane (the $-2M_{ii}$ and $-2M_{ij}$, terms). The result showed that the inductance of the spiral increased nearly linearly from L=0.1 nH at gap z=0.1 $\mu$m (where z is the gap between the top surface of the HTS spiral conductors and the bottom surface of the parallel HTS inductance suppression plate on the movable substrate), up to L=0.9 nH at z=1.0 $\mu$m, up to L=6.9 nH at z=10 su, up to L=43 nH at z=100 $\mu$m, up to nearly its free-space value of 100 nH at z=11.0 mm (L=95 nH). This illustrates the fact that unlike parallel plate variable capacitors which have a highly nonlinear $C(z)\propto 1/z$ relationship (in which capacitances fall off to extremely small values for gaps beyond 10 $\mu$m or so), variable inductors tend to have a very linear, $L(z)\propto z$ relationship out to gaps of z=1 mm or more (depending on the coil diameter). The selection of where to place the reference resonator element 100 (distributed coplanar spiral resonator as shown in FIG. 10*b*, or another type of sensing element variable capacitor or inductor), depends, in addition to non-rotational motion concerns, to the behavior of the reactive sense elements themselves. The relationship between the rotational position of the movable substrate versus the capacitance between plates on the fixed and movable substrate is quite nonlinear and the tuning frequency increases with increasing gap, z. In contrast, the relationship between the inductance of a variable inductor and the rotational position of the movable substrate is nearly linear, and the tuning frequency decreases with increasing gap, z. Interestingly, if a resonator were formed of a variable inductor, such as shown in FIG. 11*a*, on one side of the rotational axis in FIGS. 10*a*, 10*b*, 10*c*, in parallel with a variable capacitor of the type shown in FIG. 1*b* located on the opposite side of the axis, since the change in gap, z, with angle, $\phi$, in FIG. 10*a* is opposite on opposing sides of the rotation axis, both the L and C elements would tune in the same direction as the movable substrate is rotated. This could allow for the achievement of a much wider tuning range in the tunable HTS resonator. Ordinarily, with a tunable L and fixed C, or with a tunable C and a fixed L, the tuning range of the parallel L-C resonant frequency, $F_{LC}$, where $$F_{LC}=(1/2\pi)/Sqrt(LC) \text{(L-C Resonant Frequency)} \qquad \text{Eq. 48}$$

is the square root of the tuning range of the variable element (L or C). In contrast, in the suggested tunable resonator configuration implemented with variable C and variable L elements on opposite sides of the rotational axis in FIGS. 10*a*, 10*b*, 10*c*, the simultaneous tuning of L and C in the same direction would lead to a resonant frequency tuning range equal to the geometric mean of the individual variable inductor and variable capacitor tuning ranges. For example, if a variable inductor with a 16:1 inductance range were used with a fixed capacitance, the frequency tuning range would be 4:1, but if it were used in this opposing configuration with a variable capacitor having a 16:1 tuning range, the resonant frequency tuning range would be 16:1.

In the context of tuning range, it is important to note the exceptional value of the use of the dihedral (shallow "V"-shaped) movable substrate of FIG. 10*a* in preference over the flat movable substrate shown in FIG. 10*c*. Referring to the dimension notation in FIG. 10*c*, the standoff height of the substrate in parallel position, which is the gap height, $z_c$, at the center (axis of rotation), is given by the difference between the thickness of the support blocks and the movable substrate, $$z_c = t_b - t_s(\text{Gap, } z\text{, at Center of Substrate}) \qquad \text{Eq. 49}$$

The rotation of the substrate is limited by collision of the edges of the flat movable substrate and the fixed substrate to an angular range, $\phi$, given by $$-\text{Arcsin}(2z_c/h) \leqq \phi \leqq \text{Arcsin}(2z_c/h)(\text{Flat Substrate Rotational Range}) \qquad \text{Eq. 50}$$

While increasing $z_c$ increases the rotational range, it has the disadvantage that at the small gap end of the tuning range, the surfaces are not parallel, and hence very low inductance values (or very high capacitance values) cannot be reached. In fact, in the flat substrate example of FIG. 10*c* where the inductance suppression plates are shown occupying the area from r=h/6 to r=h/2 from the rotational axis, the inductance tuning range could not exceed 4:1, which is not at all bad, except in comparison to the tuning range achievable with the dihedral substrate of FIG. 10*a*.

As is clear from FIG. 10*a*, in the dihedral (shallow "V"-shaped) movable substrate configuration, the $\phi$ rotational range exceeds that given for a flat plate in Eq. 49 by the amount of the dihedral angle. Simply by selecting the appropriate dihedral angle, any desired $\phi$ rotational range may be obtained (as ± half the dihedral angle) without any need to increase the standoff height (gap at center), $z_c$. In fact, $z_c$, may be made as small as manufacturing tolerances allow without degrading the $\phi$ range, and when the dihedral substrate is rotated to the smallest gap position (illustrated in the lower of the three positions shown in FIG. 10*a*, the "lowest inductance (highest frequency) position"), the lower surface of the inductance suppression plate on the movable substrate is essentially parallel to the upper surface of the inductor coil on the fixed substrate, so that the gap volume, and hence the minimum inductance, are extremely small. Consequently, this dihedral substrate tuning range should exceed 100:1 in inductance or 10:1 in frequency, even when resonated with a fixed capacitor.

It is to be noted that many alternate embodiments of the present invention may be constructed using the magnetic actuator disclosed herein. For example, two independently tunable elements of the present invention (either variable capacitors or inductors tuned by the action of the magnetic actuators) may be coupled together to achieve a more complex filter. Thus, although specific embodiments of the present invention have been described, other features, modifications, and improvements are considered part of this invention, the scope of which is to be determined by the following claims.

What is claimed is:

1. A variable split-plate capacitor, comprising:

a fixed substrate having an upper surface;

a movable substrate having a lower surface opposing the upper surface of the fixed substrate;

a first magnetic actuator disposed on the fixed substrate, the first magnetic actuator comprising a first magnetic driver;

a first reaction plate disposed on the lower surface of the movable substrate, the first reaction plate substantially overlapping the first magnetic driver whereby a current flowing through the first magnetic driver produces a repulsive force between the first magnetic driver and the first reaction plate;

a second magnetic actuator disposed on the fixed substrate, the second magnetic actuator comprising a second magnetic driver;

a second reaction plate disposed on the lower surface of the movable substrate, the second reaction plate substantially overlapping the second magnetic driver whereby a current flowing through the second magnetic driver produces a repulsive force between the second magnetic driver and the second reaction plate;

a first capacitor plate disposed on the upper surface of the fixed substrate;

a second capacitor plate disposed on the upper surface of the fixed substrate; and a floating capacitor plate on the lower surface of the movable substrate, the floating capacitor plate substantially overlapping the first and second capacitor plates.

2. The variable split-plate capacitor of claim 1, further comprising:

a first post mounted to the upper surface of the fixed substrate on one side of the moveable substrate;

a second post mounted to the upper surface of the fixed substrate on an opposing side of the moveable substrate;

a first membrane attached at one end to the first post and at another end to the moveable substrate;

a second membrane attached at one end to the second post and at another end to the moveable substrate.

3. The variable split-plate capacitor of claim 2, wherein the first and second posts have a length that is less than the thickness of the moveable substrate.

4. The variable split-plate capacitor of claim 1, wherein the first and second magnetic drivers comprise at least one HTS layer.

5. The variable split-plate capacitor of claim 1, further comprising a pair of signal leads coupled to the first and second capacitor plates.

6. The variable split-plate capacitor of claim 1, wherein at least one of the first and second reaction plates comprises a poled HTS reaction plate comprising at least one concentric closed loop of HTS material.

7. The variable split-plate capacitor of claim 1, further comprising at least one permanent magnet material poled to attract one of the first and second magnetic drivers disposed in the moveable substrate adjacent to one of the first or second reaction plates to provide push-pull actuation.

8. A device comprising:

a fixed substrate having opposing surfaces separated by a gap;

a moveable substrate disposed in the gap between the opposing surfaces of the fixed substrate;

a first magnetic actuator disposed on the fixed substrate, the first magnetic actuator comprising a first magnetic driver;

a second magnetic actuator disposed on the fixed substrate, the second magnetic actuator comprising a second magnetic driver;

at least one reaction plate disposed on a surface of the moveable substrate; and at least one permanent magnet material poled to attract one of the first and second magnetic drivers, the at least one permanent magnet material disposed in the moveable substrate adjacent to the at least one reaction plate.

9. The device of claim 8, wherein the first and second magnetic drivers comprise a continuous strip of HTS material.

10. The device of claim 9, wherein the first and second magnetic drivers are planar spiral coils.

11. A device comprising:

a fixed substrate having an upper surface;

a pair of suspension posts disposed on the upper surface of the fixed substrate;

a moveable substrate having a lower surface opposing the upper surface of the fixed substrate, the moveable substrate being suspended above the upper surface of the fixed substrate via a torsion fiber extending between the pair of suspension posts, the torsion fiber being positioned on the centerline of the moveable substrate;

a first magnetic driver disposed on the fixed substrate and offset from the centerline of the moveable substrate;

a second magnetic driver disposed on the fixed substrate and offset from the centerline of the moveable substrate in an opposite direction from the first magnetic driver;

a first reaction plate disposed on the lower surface of the movable substrate, the first reaction plate substantially overlapping the first magnetic driver; and a second reaction plate disposed on the lower surface of the movable substrate, the second reaction plate substantially overlapping the second magnetic driver.

12. The device of claim 11, wherein the moveable substrate has a dihedral configuration.

13. The device of claim 11, further comprising:

a spiral HTS resonator disposed on the fixed substrate; and a HTS inductance suppression plate disposed on the moveable substrate above the spiral HTS resonator.

14. The device of claim 11, further comprising:

a first capacitor plate disposed on the upper surface of the fixed substrate;

a second capacitor plate disposed on the upper surface of the fixed substrate; and a floating capacitor plate on the lower surface of the movable substrate, the floating capacitor plate substantially overlapping the first and second capacitor plates.

15. The device of claim 11, further comprising a feedback position control reference oscillator.

16. The device of claim 11, further comprising:

a spiral HTS inductor disposed on the fixed substrate; and a HTS inductance suppression plate disposed on the moveable substrate above the spiral HTS inductor so as to substantially overlap the spiral HTS inductor.

17. The device of claim 16, wherein the HTS inductance suppression plate comprises a plurality of concentric loops of HTS material arranged at a pitch that substantially matches the pitch of the spiral HTS inductor.

18. The device of claim 11, wherein the moveable substrate is planar.

19. A device comprising:

a fixed substrate having an upper surface;

a moveable substrate having a lower surface opposing the upper surface of the fixed substrate;

a reaction plate disposed on the lower surface of the moveable substrate;

a magnetic driver disposed in the fixed substrate;

a HTS resonator disposed on the fixed substrate; and a HTS inductance suppression plate disposed on the moveable substrate above the HTS resonator.

20. The device of claim 19, further comprising at least one permanent magnet material poled to attract the magnetic driver disposed in the moveable substrate adjacent to the reaction plate.

* * * * *